US008875793B2

(12) United States Patent
Christensen et al.

(10) Patent No.: US 8,875,793 B2
(45) Date of Patent: Nov. 4, 2014

(54) CONNECTING DEVICE FOR KILL/CHOKE LINES BETWEEN A RISER AND A FLOATING DRILLING VESSEL

(75) Inventors: Øystein Christensen, Kristiansand (NO); Atle Korsmo, Kristiansand (NO)

(73) Assignee: SRI Sports Limited, Kobe (JP)

( * ) Notice: Subject to any disclaimer, the term of this patent is extended or adjusted under 35 U.S.C. 154(b) by 91 days.

(21) Appl. No.: 13/508,762

(22) PCT Filed: Nov. 10, 2010

(86) PCT No.: PCT/NO2010/000408

§ 371 (c)(1), (2), (4) Date: Sep. 4, 2012

(87) PCT Pub. No.: WO2011/059340

PCT Pub. Date: May 19, 2011

(65) Prior Publication Data

US 2012/0318517 A1 Dec. 20, 2012

Related U.S. Application Data

(60) Provisional application No. 61/259,853, filed on Nov. 10, 2009.

(30) Foreign Application Priority Data

Nov. 10, 2009 (NO) ..... 20093312

(51) Int. Cl.
*E21B 19/00* (2006.01)
*E21B 17/07* (2006.01)

(52) U.S. Cl.
CPC ..... *E21B 19/004* (2013.01); *E21B 19/006* (2013.01); *E21B 17/07* (2013.01)
USPC ..... 166/345; 166/352; 166/367; 405/224.2

(58) Field of Classification Search
CPC ..... E21B 17/07; E21B 19/004; E21B 17/01; E21B 19/006; E21B 19/22
USPC ..... 166/345, 341, 342, 346, 347, 352, 367, 166/85.1; 405/169, 184.4, 224.2
See application file for complete search history.

(56) References Cited

U.S. PATENT DOCUMENTS

| | | | | |
|---|---|---|---|---|
| 4,102,146 | A * | 7/1978 | Dietrich | 405/169 |
| 4,401,164 | A | 8/1983 | Baugh | |
| 4,661,017 | A * | 4/1987 | Wood et al. | 405/169 |
| 4,668,126 | A * | 5/1987 | Burton | 405/169 |
| 4,770,563 | A * | 9/1988 | Pido | 405/169 |
| 5,846,028 | A * | 12/1998 | Thory | 405/195.1 |
| 7,040,393 | B2 * | 5/2006 | Adams et al. | 166/77.51 |

(Continued)

FOREIGN PATENT DOCUMENTS

GB 2 047 306 A 11/1980

*Primary Examiner* — Matthew Buck
(74) *Attorney, Agent, or Firm* — Birch, Stewart, Kolasch & Birch, LLP

(57) ABSTRACT

A connector device for kill- and choke lines between a riser and a floating drilling platform includes a slip joint on top of the riser including an outer barrel, a kill- and choke manifold arranged on the platform and provided with flexible kill- and choke hoses to the slip joint's outer barrel, and wherein the slip joint's outer barrel is provided with a horizontally directed kill- and choke-manifold.

9 Claims, 26 Drawing Sheets

(56) References Cited

U.S. PATENT DOCUMENTS

| | | | | |
|---|---|---|---|---|
| 7,658,228 | B2 * | 2/2010 | Moksvold | 166/345 |
| 8,267,179 | B2 * | 9/2012 | Butcher et al. | 166/341 |
| 8,403,065 | B2 * | 3/2013 | Taylor et al. | 166/378 |
| 2005/0061546 | A1 * | 3/2005 | Hannegan | 175/7 |
| 2007/0284113 | A1 * | 12/2007 | Haheim | 166/345 |
| 2008/0210471 | A1 * | 9/2008 | Bailey et al. | 175/48 |
| 2011/0005764 | A1 * | 1/2011 | Bekkevold | 166/344 |
| 2011/0056701 | A1 * | 3/2011 | Jones et al. | 166/378 |
| 2011/0073314 | A1 * | 3/2011 | Zijderveld et al. | 166/345 |
| 2013/0240214 | A1 * | 9/2013 | Faye | 166/345 |

* cited by examiner

CONNECTING DEVICE FOR KILL/CHOKE LINES BETWEEN A RISER AND A FLOATING DRILLING VESSEL

This application is the National Phase of PCT/NO2010/000408 filed on Nov. 10, 2010, which claims priority under 35 U.S.C. 119(e) to U.S. Provisional Application No. 61/259,853 filed on Nov. 10, 2009, and under U.S.C. 119(a) to Patent Application No. 20093312 filed in Norway on Nov. 10, 2009, all of which are hereby expressly incorporated by reference into the present application.

This invention relates to a connecting device for kill- and choke hoses at a riser. More specifically it relates to a remote controlled automatic connecting device for kill- and choke hoses between a riser and their adjacent kill- and choke flexible housings from a kill/choke manifold at a rig. A first advantage of the invention is that it facilitates the connecting process due to the horizontal operation instead of the vertical operation wherein the risers pendulum movement otherwise makes the connecting less secure. A second advantage of the invention is that the operator may stand on a place at a distance from the riser and target in and remote-control the connection in a way that one may avoid any operator to hang in riding belts. The operation becomes more secure to the operator and safer due to the easier targeting of the connecting manifold to the riser's kill/choke manifold, in addition the connection may be conducted faster.

Some Background Information: a Short Overview of Marine Drilling for Oil

During marine drilling, for instance during drilling of exploration wells or production wells, it is placed a drilling template or template at the sea-floor, wherein one usually first drill a pretty shallow 36" borehole and lines with a 30" casing, a so-called conductor casing. Both the drill pipe and the casings are put together by screwing by help of a top drive drilling motor in a drawwork, for instance hanging in the crown block in an regular drilling derrick or in the spreader at a hydraulic Ram Rig and getting lowered through the drilling template or the template. So one may get a stable top section of the well for further drilling and one may prevent earth fall into the well and one prevents to go beyond the pressure of the ambient relatively uncompacted or unconsolidated sediments, which have a low fractionating pressure so close to the surface. By this initial drilling a relative thin slurry which is not returned to the drilling platform at the sea surface is used. Further it is drilled with a 26" bit through the conductor casing and thereafter it's used a casing of 20" mainly in the whole length of the drilled hole, the conductor casing included. This improves the stability of the bore hole wall against fractioning to deeper brehole depths, at the same time as one improves the hole to manage higher pressure from the return sludge when a riser arrives later on. Neither when drilling with 26" bit it is used a heavy drilling mud, but a relative thin slurry. The drill string comprise a bit inclusive a so called "bottom hole assembly" BHA in the bottom end of multiple drill pipes which are screwed together. BHA comprises a drill collar and a possible drilling instrumentation. The drill pipes have a narrower diameter than the bit. It is the drill collar that provides the essential weight of the bit against the bottom of the hole during drilling. The weight of the bore hole is being compensated by the crown block so that the drill string is upheld and prevents that it buckles in the well.

The Riser

When the 20" casing is inserted into the well there is a blow out valve BOP and a riser (1) at the top of this to be installed via a ball joint at the BOP. Kill- and choke-hoses passing the ball joint may be coiled up some few turns to stand the torsion movements up to about 4 degrees in the ball joint. The blow out valve is installed at the well head which is comprised of the top-part of the installed casing pipes in the template, the one inside the previous, usually 30" and 20" casings. The blow out valve BOP is skidded in at a sledge (59) in the moonpool at a cellar deck (58) under the rig floor (55) and thereafter is mounted, one by one, riser sections (13) by use of their lower flange connector (132) in the top of every hanging riser line (1) hanging in slips (56) in the rig floor (55). The connected riser line (1) may then be lowered further by using the crown block or the spreader in the drilling derrick, and be lowered, section by section, until a desired depth is reached, as the BOP reaches the well head. This process terminates by installing a so-called slip joint (2) on top of the upper so-called landing string (60). This has to take place outside the template to prevent a catastrophe if one should lose and drop the riser string at the template. Then the BOP and the riser is swung in over the template and the BOP is lowered down to the well head when the BOP is in the correct position on top of this, and is locked by, special purpose hydraulic mechanisms.

Slip joint (2) comprises a so-called outer barrel (21) which is the lower, static part which follows all the underlying riser sections vertical movements and which in its operative condition is in a locked position relative to the seabed and the well. The slip joint outer barrel (21) envelopes a vertical plain sliding inner barrel (22) which in its operative position should be hung up fixed in the vessel and follow the vertical movements of the vessel, as distinct from the riser (1) and the slip joint outer barrel (21) which thus may be heave compensated.

The role of the riser (1) is twofold. The riser shall guide the next drill string with a 18⅜" bit from the rig floor down through the complete riser length, further down through the BOP and the existing 30" and 20" casing pipes and drill further down under the 20" casing pipes' lower end. During this operation it is used a heavier drill mud which is pumped from a drill mud pump system at the rig floor, down through the drill string and out through the bit. The drilling mud washes the bit and the bottom of the hole clean from rock type fragments, and due to the density and the viscous properties of the drill mud, the drill mud brings the rock type fragments back up through the annular space both in the naked bore hole, the cased part with the 20" casing and out through the well head, BOP and up through the riser, along the outside of the drillstring.

Due to the heave movement of the drilling vessel at the sea surface, both the riser (1) with the slip joint outer barrel (21) and the drill string must be heave compensated. The heave compensation of the drill string is carried out by use of the crown block's or the spreader's wires which is tightened and slacked automatically so that there is a relative constant tension in the drill string so that there will not be an undesired variation of the pressure from the bit against the bottom of the borehole.

Normally, along the riser (1), there are fixed kill (11)- and choke (12) pipelines parallel and on each opposite sides of the riser (1). The purpose of the kill- and choke-pipelines is to be able to add sufficient heavy fluid to "kill" the well by filling the well with heavy fluid, or by cutting the drill string by use of a shear ram, or choke around the drill string by a "choke"-valve. The kill (11) and choke (12)-pipelines are lead through the upper flange (132) and are arranged with vertically directed pipe ends (111, 112) with appurtenant high pressure gaskets arranged for fitting up and into the corresponding kill/choke hoses' receptacles (115, 116) at the lower flange of the above placed riser section (13). The vertically directed pipe ends (111, 112) are arranged for fitting into the corresponding receptacles (115, 116) in the lower flange of the slip joint outer barrel (21) as well as, in the same way, are provided with kill- and choke-lines (11, 12) with corresponding vertically directed pipe ends (211, 212) in a vertically directed slip-joint kill/choke manifold (23) near the top of the slip joint outer barrel (21). Such vertical connecting manifolds often comprise to halves which has to be coupled together more or less manually around the slip joint by help of an operator hanging in ride belts, before the coupled connecting manifold is lowered and connected to the vertically directed slip joint kill/choke manifold. Connection of kill-choke hoses may also be performed by so-called "goosenecks" which are guided onto and down onto the vertically upwards directed pipe ends at the kill and choke lines. Such vertically directed slip joint kill/choke manifolds (23) are arranged to be connected to a vertically connecting manifold (24) according to prior art. The vertically connecting manifold (24) has to be guided and pushed into a position above the vertically slip joint kill/choke manifold (23) and then be guided and lowered over this, and then coupled, and locked.

In addition, there may be arranged two or more so-called conduit-lines (14) for control hydraulics for the valves and the connections in the BOP, and the so-called "booster" lines for injecting of fluid to for instance the gas lift valves into the lover part of the riser. The gas lift valves are arranged for injecting fluid so that the density of the drilling mud above is somewhat reduced so that the return flow of the drilling mud in the riser is made more efficient.

Some companies land the riser and the BOP with a fully extended slip joint, other with a collapsed (contracted) slip joint wherein the landing string is fixed in the upper part of the inner barrel.

When the riser with the BOP is landed and mounted, the further drilling and casing operations may proceed through this until the well has got its desired depth or length. The drilling is carried out during counter pressure from the drilling mud.

Problems Related to the Prior Art

The all set and mounted riser (1) with a slip joint (2) hangs from the top drive drilling motor in the crown block in the derrick or the spreader in the Ram Rig—derrick, in a landing string (60). This vertically directed slip joint kill/choke manifold (23) is arranged for being connected to a vertically connecting manifold (24) in accordance to the prior art. The entire riser arrangement then hangs in a landing string (60) from the top drive which is close to an upper position in the derrick. In this position there will be a considerable distance from the top drive and down to the slip joint kill/choke manifold (23). The vertical connecting manifold (24) must be guided and pushed into a position over the vertical slip joint kill/choke manifold (23) and then guided and lowered down over this, connected, and locked. The vertically directed kill/choke pipe ends (211, 212) at the slip joint kill/choke manifold (23) are in a freely hanging position just under the cellar deck (58) which is in a considerable distance under the top drive, generally between 30 and 40 meter.

A problem by the prior art is that the vertical connecting manifold usually has to be connected manually together by two ring halves for being arranged around the slip joint, by manual assistance from an operator who hangs in ride belts, before the coupled connecting manifold are lowered down and coupled to the vertical slip joint kill/choke manifold. The long distance between the top drive and the slip joint kill/choke manifold will contribute to a not insignificant pendulum movement of the slip joint kill/choke manifold (23) relative to the rig floor (55) and particularly the cellar deck with moonpool (58) and the equipment that follows its motions, for instance the vertical connecting manifold (24). This pendulum movement which has large horizontal swing is caused by the roll and the horizontal movement of the rig. Those movements do not correspond with the movements of the riser and its slip joint manifold's (23) horizontal movements. The vertical movements of the slip joint manifold (23) will, in this situation, correspond well to the vertical movements of the cellar deck. Consequently it will be difficult to guide the vertical kill/choke connecting manifold (24) into the right position over the vertical slip joint kill/choke manifold (23) at the slip joint, and to guide and lower the vertical connecting manifold (24) down to the right position at the kill/choke manifold (23).

The problem related to such vertical connecting comprises several issues: partly to find a quiet moment where the horizontal relative movements are sufficiently quiet to actually conduct the connecting operation, partly that the vertical relative movements may not be fully compensated, partly that the operator must find him/herself in a position where he or she can aim in and steer the movements that are required for the coupling, and partly that the operator needs to hang in ride belts as well both to aim in and to perform the manual operations for coupling the mechanical components or for pulling wires.

Below, FIGS. 1 to 8 are described, which all are about the prior art operation.

FIG. 1 shows a simplified cross-section through a drilling platform's drilling deck and cellar deck and an upper part of a riser being assembled, wherein a riser tension ring is attached to the diverter housing and before the slip joint outer barrel is lowered through the diverter housing and is landed in the riser tension ring. Vertically arranged pipe ends are here arranged at the slip joint outer barrel in a distance under the landing flange at the top of the slip joint outer barrel. Kill- and choke lines at the so called "goosenecks" with vertically downward directed kill and choke connection manifold receptacles hanging ready in the cellar deck level in wires.

FIG. 2 illustrates a further step in the prior art, wherein the slip joint outer barrel's landing flange is placed in the tensioner ring while this still sits in the diverter housing.

FIG. 3 illustrates further the prior art, wherein the tensioner ring is released from the diverter housing. All the load is no transferred to the top drive (not shown) and the riser and the slip joint lowers down to place the slip joint's vertically upwards directed pipe ends at the kill- and choke lines leveled just below the downwards directed kill- and choke-connection manifold receptacles in the so-called "goosenecks" at the cellar deck level.

FIG. 4 illustrates a subsequent step in the prior art, wherein the slip joint's vertically upward directed pipe ends on the kill- and choke lines is lowered to a level just below the downward directed kill- and choke-connection manifold receptacles at the cellar deck level.

FIG. 5 illustrates a subsequent step in the prior art, wherein the so-called goosenecks with the downwards directed kill- and choke connection manifold receptacles are guided horizontally inwards until they are in positions over the slip joint's vertically upwards directed pipe ends of the kill- and choke lines. The goosenecks still hang from wires. Those goosenecks may be assembled to a kill- and choke connection manifold as part of a ring, but still have vertically directed receptacles. Please notice that this operation of guiding inwards towards the riser is conducted while the entire riser and slip joint barrel hang in a pendulum motion from the top drive which is mounted into the derrick's main block which resides at a 30 to 40 meters higher elevation.

FIG. 6 illustrates a subsequent lowering of those goosenecks with their vertical receptacles town onto the vertically upwards directed pipe ends ("stabbers") of the kill- and choke lines. A connection has now been established between the riser's kill- and choke lines via those vertically directed gooseneck connectors to kill- and choke hoses which conduct further to the platform's kill- and choke manifold on board. The riser with its BOP may now be lowered towards the wellhead.

FIG. 7 illustrates a preliminary final step of the prior art wherein the riser has been lowered using the top drive until the BOP has been landed on the wellhead. The riser's weight has been transferred to tension wires which are being kept under tension by heave compensators. The slip joint barrel is further connected via a so-called flex joint to the diverter housing. The riser is now prepared for the further drilling operation with drilling mud through the drill string with drilling mud return through the riser's annulus about the drill string and back out through the diverter housing with return to a drilling mud shaker plant for separating out drilling cuttings.

FIG. 8 illustrates an essential problem of the prior art whereby the operation of horizontal introduction of the kill- and choke manifolds towards the riser and the subsequent vertical lowering of those towards the vertical pipe ends or "stabs" on top of the kill- and choke lines of the riser shall be conducted while the entire riser and slip joint barrel hang from the derrick tower's main block which is 30 to 40 meters above. The drawing illustrates probably encountered amplitudes as a function of roll and lateral movement of the platform relative to the riser's movement, which do not necessarily be in phase or have the same amplitudes. In such a situation also operators shall work and provide manual assistance while hanging in riding belts and whereby the operator himself is also hanging in a pendulum motion.

Generally it is desirable to replace manual operations, which involves risks for human injuries, by mechanized and/or remote-controlled operations wherein the operator controls the process at a certain distance. A classic example is when about 1989 it was introduced mechanized pipe handling of drill pipes and risers over the rig floor, both for assembling and disassembling pipestrings. This action resulted in a substantial decrease in the amount of human injuries.

UK patent application published as GB 2 047 306 describes a well servicing rig for land use. It describes automatic handling of well elements such as pipe, tubing and rods, which are run into and taken out of the well. However, problems related to a riser and its inherent differential motions relative to a rig are not a problem of that GB publication.

US patent application publication US 2007/0284113 A1 describes a horizontally directed connector for kill- and choke lines to a well logging head. The connector is, however, hung from vertical chains, and is intended for use under workover operation.

SHORT SUMMARY OF THE INVENTION

The present invention solves some of the above mentioned problems by introducing a horizontally directed outer barrel kill- and choke-manifold with horizontally directed receptacles arranged for receiving horizontally directed connection pipe ends at the connection manifold. This horizontally directed manifold is arranged for connecting to a corresponding connection manifold which is mounted at a manipulator arm and provided with horizontally directed connection pipe ends.

In another aspect, the invention is a way to provide the riser's outer barrel with a horizontally directed kill/choke manifold, to provide the rigs kill/choke lines with a corresponding horizontally directed kill/choke connection manifold, to stabilize the riser with its horizontally directed kill/choke manifold in the desired level compared to the horizontally directed kill/choke connecting manifold, and then directing and "stabbing" the horizontally directed connecting manifold in a horizontal direction into the horizontally directed manifold of the riser.

The invention is defined by the attached claims and illustrated in the drawings and explained in the description of the embodiments of the invention. Preferred embodiments of the invention are defined in the appurtenant dependent claims.

Advantages of the Invention

A first advantages of the invention is that it is easier to aim in on the target and hit it with the horizontal connecting manifold into the horizontally directed manifold due to their small relative vertical movement. It might be considerably easier to stand on a rig floor and direct the connecting manifold in a direct line as seen from an operator's position in a horizontal distance from the riser than finding oneself hanging in ride belts close to the riser. The operator does, roughly speaking, only decide whether the horizontally connecting manifold and the manifold are in the desired relative positions or not. In the situation where the operator is hanging in ride belts he may be exposed to injuries by impacts against the riser and its protruding flanges, and may be exposed to being crushed between the kill/choke—hoses and the riser, or between hanging heavy tools and the riser. All in all, the operator will be placed at a distance from the danger zone near the moving riser, and the inventor envisages that the risk of and the number of personnel injuries will be considerably reduced.

A second advantage of the invention is that there is no need for first performing a horizontal connection of the vertical manifold ring and then conducting a vertical lowering of the vertical manifold ring as in prior art, it requires generally only a horizontal movement of the connecting manifold. In addition to the fact that the operator does not need to couple the two halves of any vertical connecting manifold together, he may accordingly be situated at a distance and aim in for and direct into a horizontal connecting manifold without any risk of injuries on his own body, and needs generally to conduct the connecting by using fewer operations.

SHORT FIGURE CAPTIONS

Part of the background art and the invention is illustrated in the attached drawings, wherein FIG. 1 shows background art and is a simplified cross-section through a drilling platform's drilling deck and cellar deck and an upper part of a riser being assembled, wherein a riser tension ring is attached to the diverter housing and before the slip joint outer barrel is lowered through the diverter housing and is landed in the riser tension ring.

Figure 1:
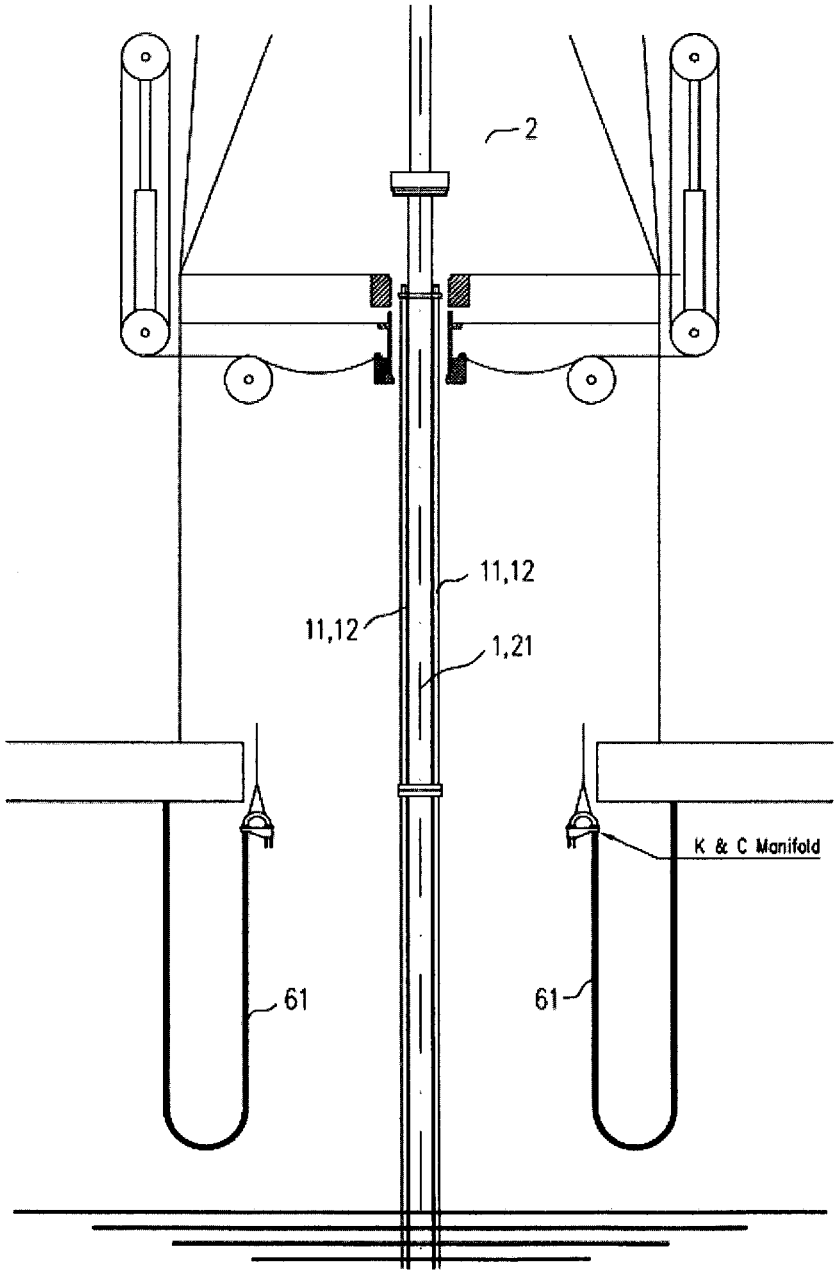
Fig. 1 (Prior Art)
Figure 2:
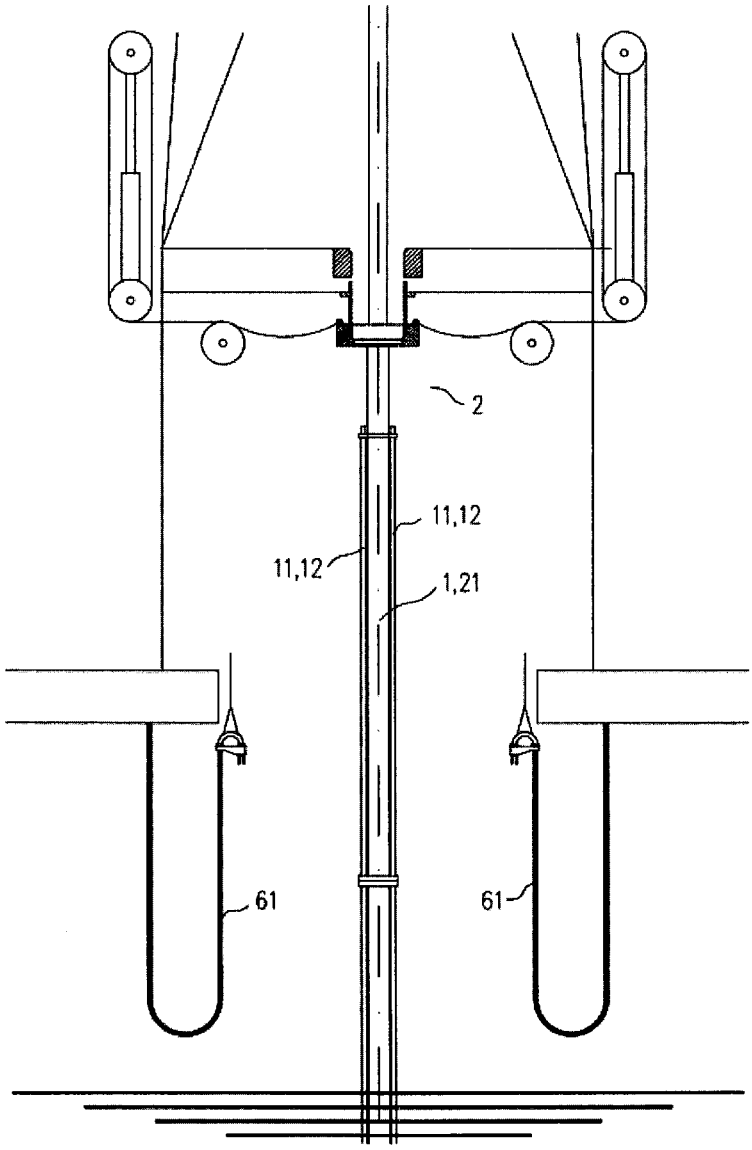
Fig. 2 (Prior Art)
FIG. 2 illustrates a further step in the prior art, wherein the slip joint outer barrel's landing flange is placed in the tensioner ring while this still sits in the diverter housing.
Figure 3:
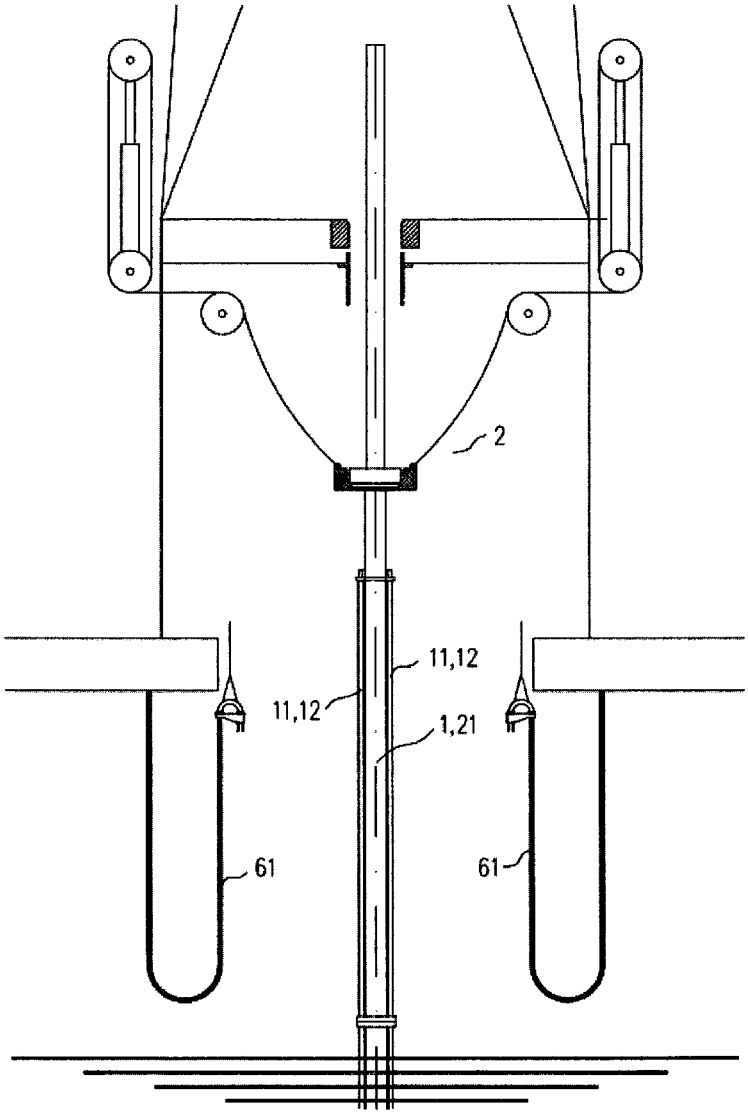
Fig. 3 (Prior Art)
FIG. 3 illustrates further the prior art, wherein the tensioner ring is released from the diverter housing.
Figure 4:
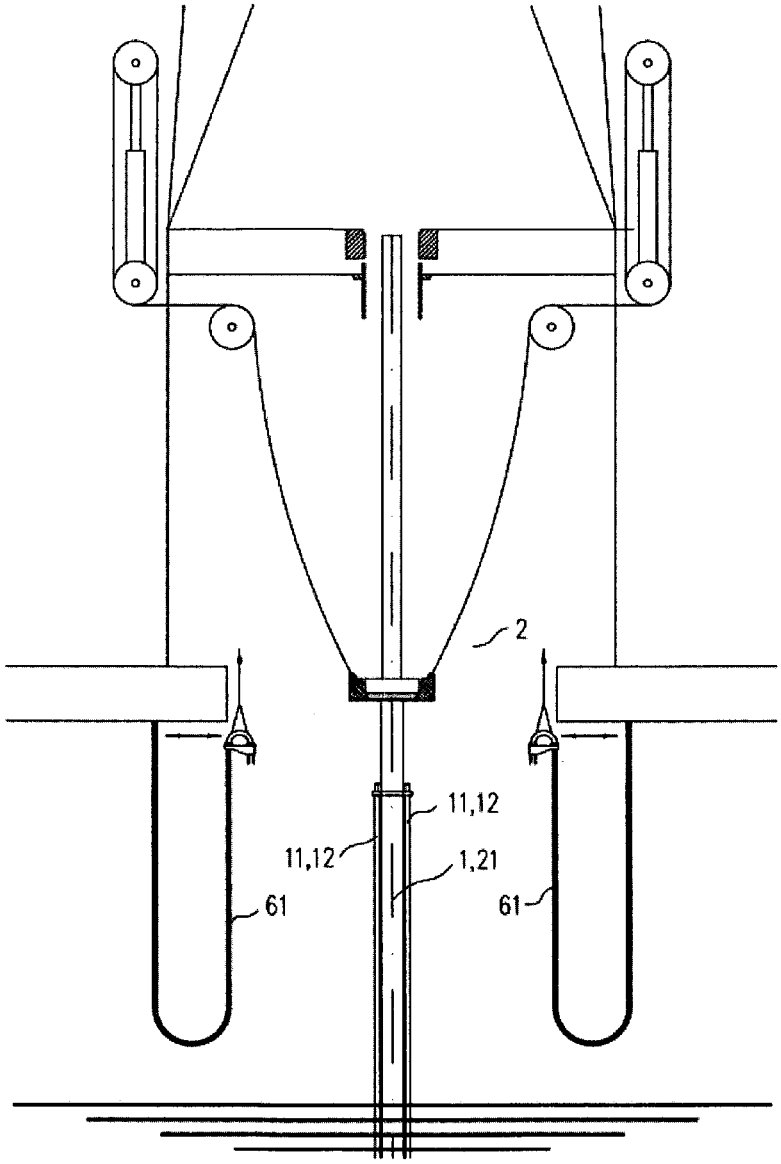
Fig. 4 (Prior Art)
FIG. 4 illustrates a subsequent step in the prior art, wherein the slip joint's vertically upward directed pipe ends on the kill- and choke lines is lowered to a level just below the downward directed kill- and choke-connection manifold receptacles at the cellar deck level.
Figure 5:
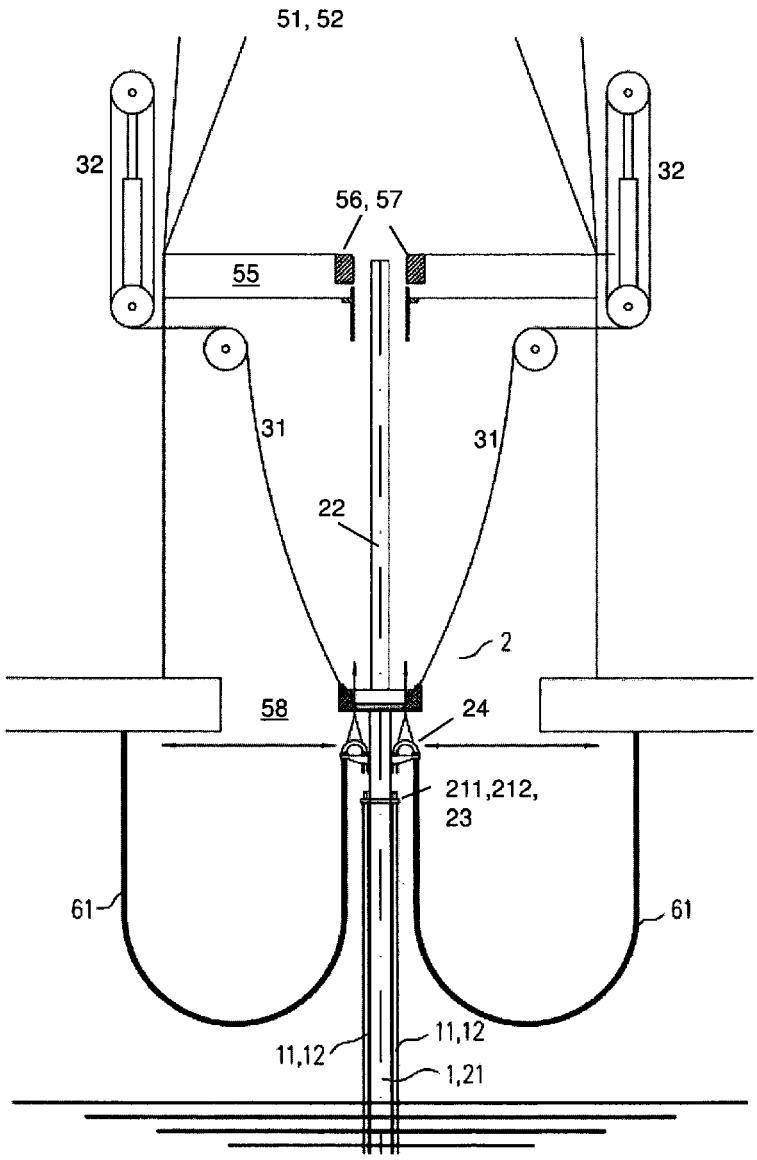
Fig. 5 (Prior Art)
Figure 5B:
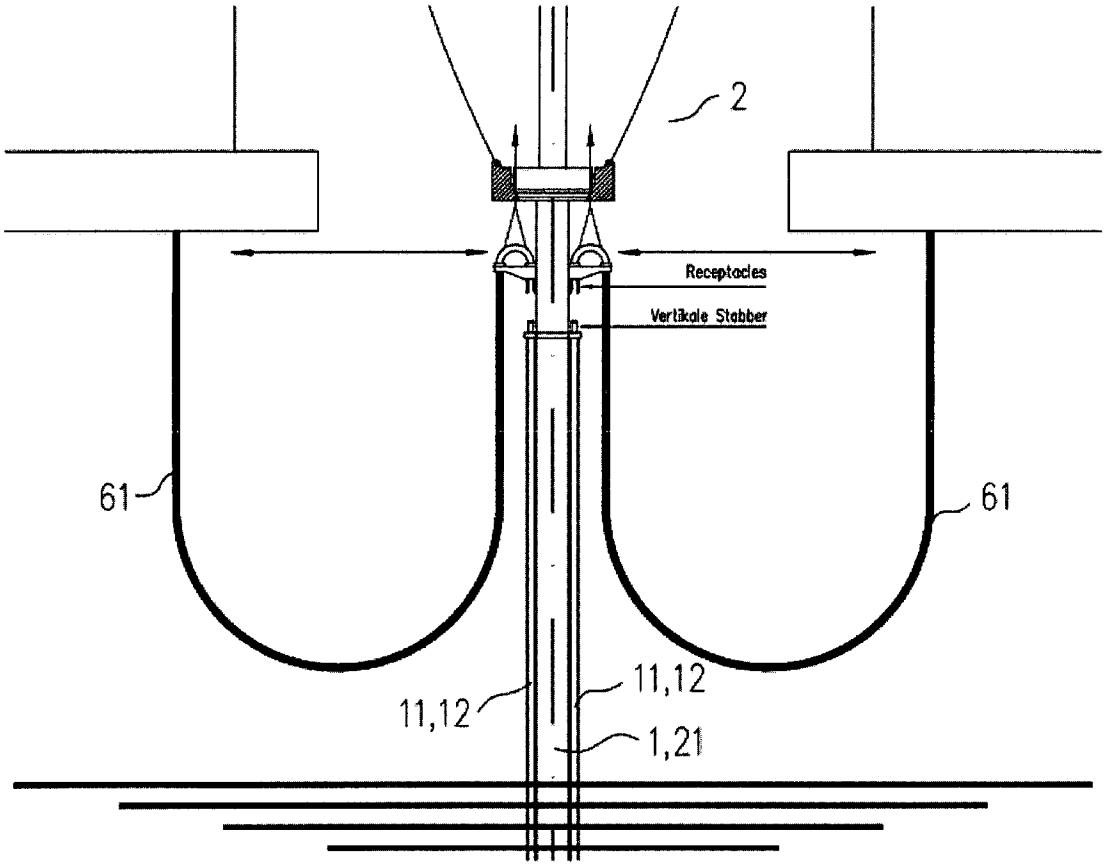
Fig.5b (Prior Art)

FIG. 5 illustrates a subsequent step in the prior art, wherein the so-called goosenecks with the downwards directed kill- and choke connection manifold receptacles are guided horizontally inwards until they are in positions over the slip joint's vertically upwards directed pipe ends of the kill- and choke lines. The goosenecks still hang from wires. Those goosenecks may be assembled to a kill- and choke connection manifold as part of a ring, but still have vertically directed receptacles. Please notice that this operation of guiding inwards towards the riser is conducted while the entire riser and slip joint barrel hang in a pendulum motion from the top drive which is mounted into the derrick's main block which resides at a 30 to 40 meters higher elevation.

Figure 6:
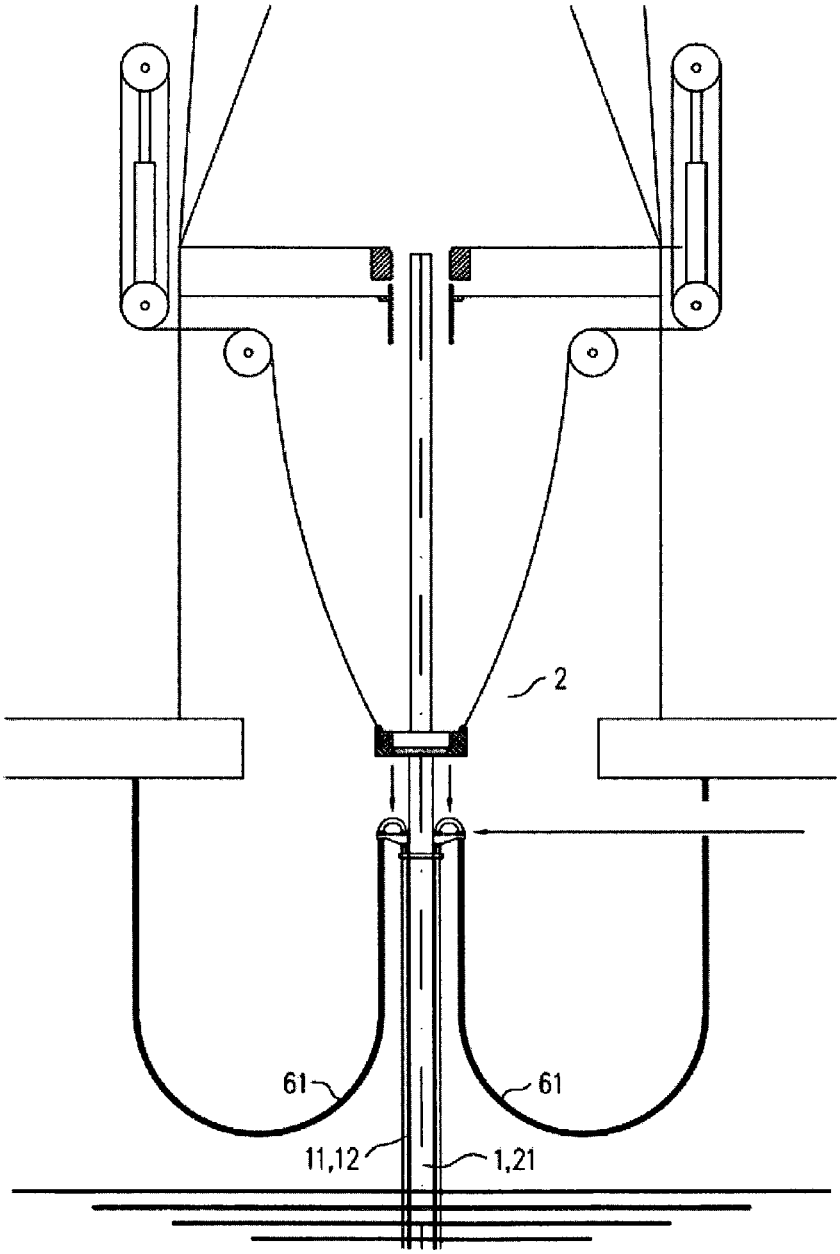
Fig. 6 (Prior Art)

FIG. 6 illustrates a subsequent lowering of those goosenecks with their vertical receptacles town onto the vertically upwards directed pipe ends ("stabbers") of the kill- and choke lines. A connection has now been established between the riser's kill- and choke lines via those vertically directed gooseneck connectors to kill- and choke hoses which conduct further to the platform's kill- and choke manifold on board. The riser with its BOP may now be lowered towards the wellhead.

Figure 7:
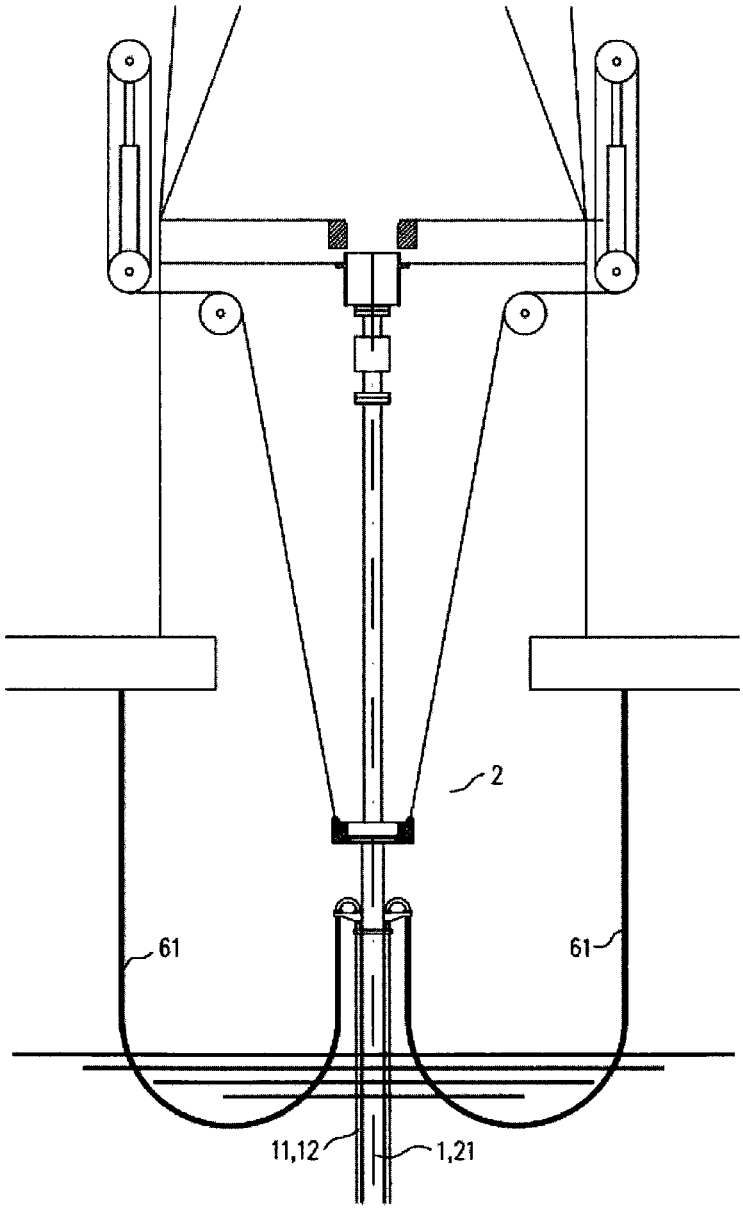
Fig. 7 (Prior Art)

FIG. 7 illustrates a preliminary final step of the prior art wherein the riser has been lowered using the top drive until the BOP has been landed on the wellhead. The riser's weight has been transferred to tension wires which are being kept under tension by heave compensators. The slip joint barrel is further connected via a so-called flex joint to the diverter housing. The riser is now prepared for the further drilling operation with drilling mud through the drill string with drilling mud return through the riser's annulus about the drill string and back out through the diverter housing with return to a drilling mud shaker plant for separating out drilling cuttings.

Figure 8:
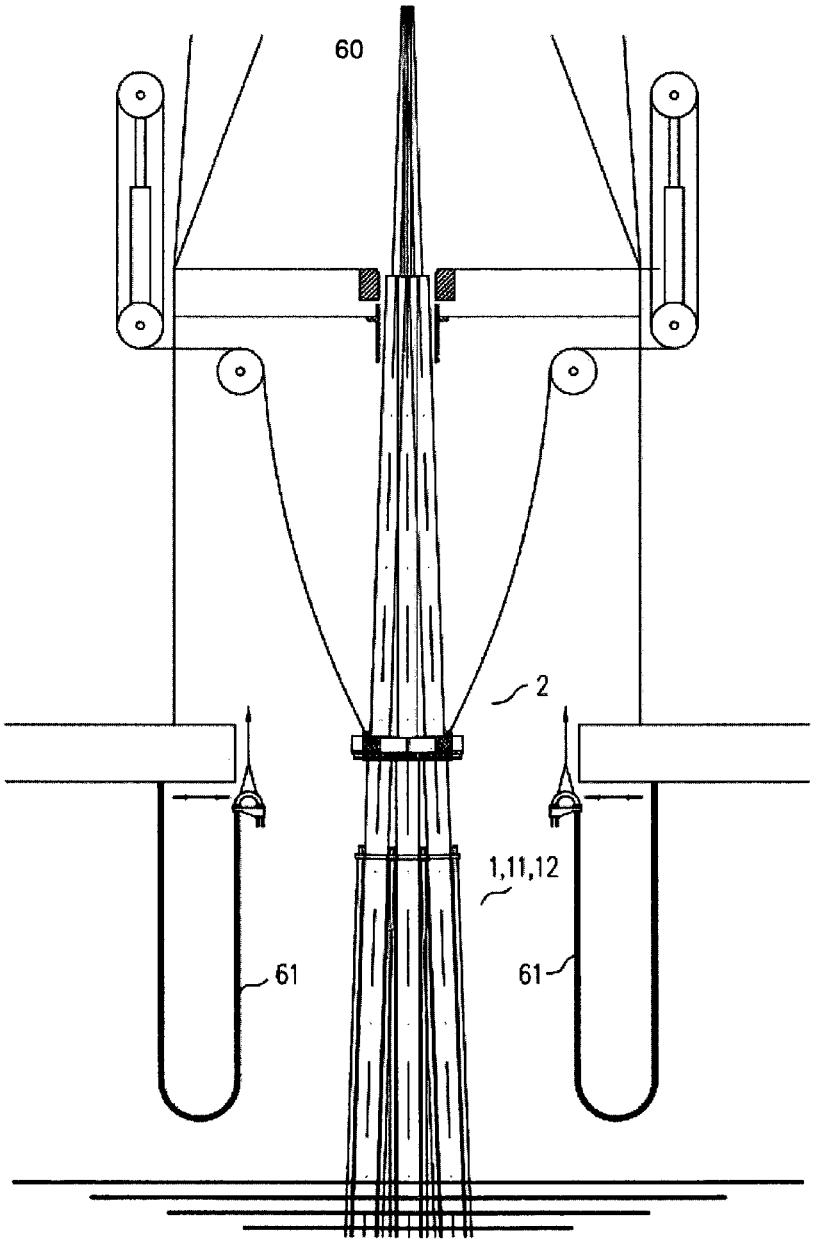
Fig. 8 (Prior Art)

FIG. 8 illustrates an essential problem of the prior art whereby the operation of horizontal introduction of the kill- and choke manifolds towards the riser and the subsequent vertical lowering of those towards the vertical pipe ends or "stabs" on top of the kill- and choke lines of the riser shall be conducted while the entire riser and slip joint barrel hang from the derrick tower's main block which is 30 to 40 meters above. The drawing illustrates probably encountered amplitudes as a function of roll and lateral movement of the platform relative to the riser's movement, which do not necessarily be in phase or have the same amplitudes. In such a situation also operators shall work and provide manual assistance while hanging in riding belts and whereby the operator himself is also hanging in a pendulum motion.

Figure 9:
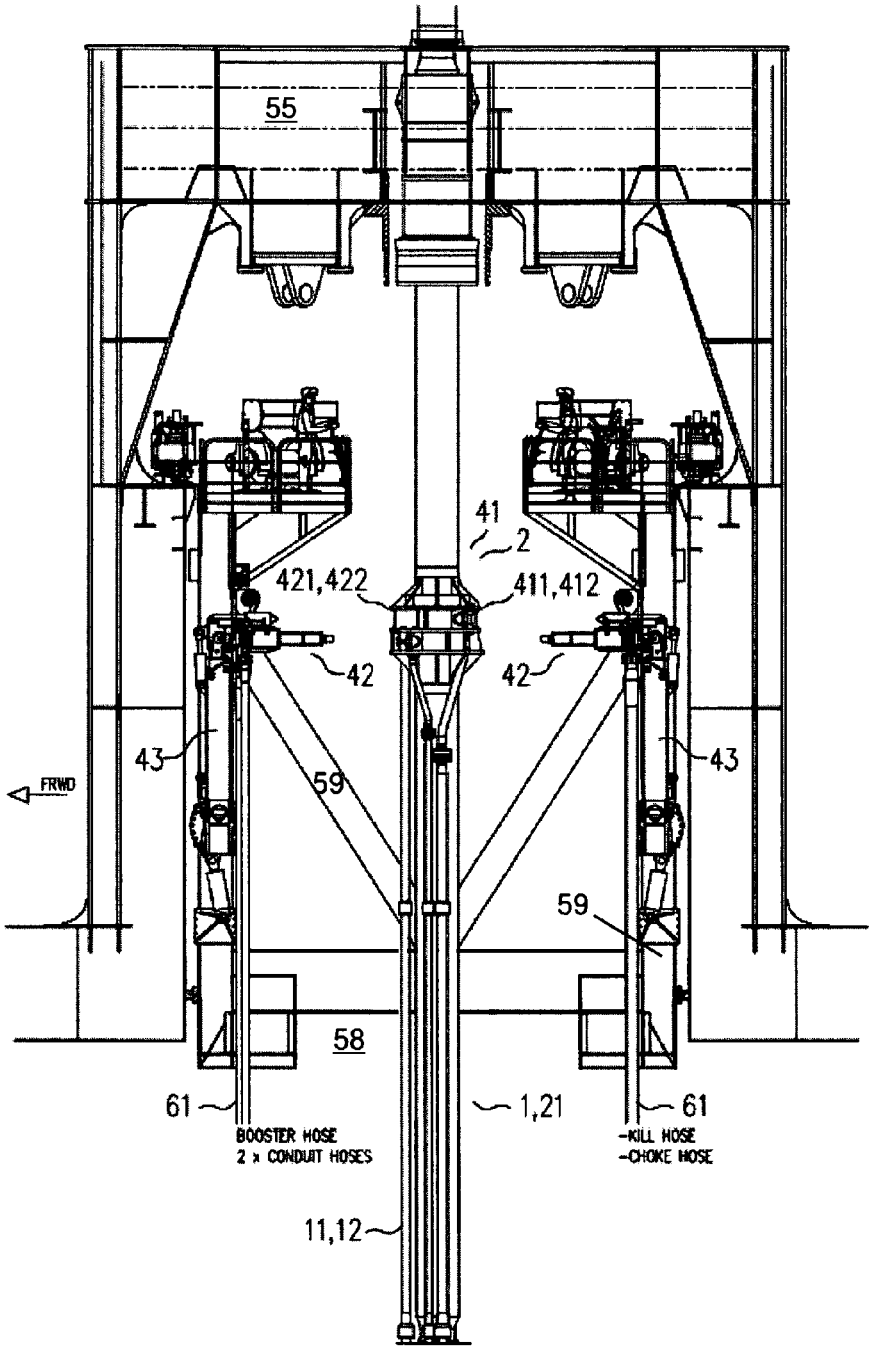

FIG. 9 illustrated an embodiment of the invention. The drawing is a cross-section through a drilling platform through a central portion of the drilling deck and auxiliary platforms below the drilling deck, and through the cellar deck. The drawing is also a cross-section through a moonpool which extends athwart of the vessel and wherein is arranged a skid for a BOP which may be run in from the side and in under the opening in the drilling deck. The riser here hangs from the top drive (not shown) and down through the opening in the drilling deck and the diverter housing and extends further down to the BOP which hangs in a desired elevation above the wellhead. According to this embodiment of the invention, horizontally directed kill- and choke connector manifolds, with kill- and choke hoses from the platform's side, are arranged on the skid and arranged for being guided in into two corresponding and oppositely directed horizontally directed kill- and choke manifolds on the riser's slip joint outer barrel. In this rather concrete case, the kill- and choke connector manifold in the right part of the drawing and a corresponding connecting manifold with booster- and two conduit hoses is shown in the left part of the drawings. The extensive guide pins of the connecting manifolds dominate the image and extend inwardly towards apertures of corresponding guiding sleeves of the kill- and choke manifold on the slip joint outer barrel, and must not be confused with connecting pipe ends and receptacles which will be shown in between those on subsequent Figures, please see FIG. 12.

Figure 10:
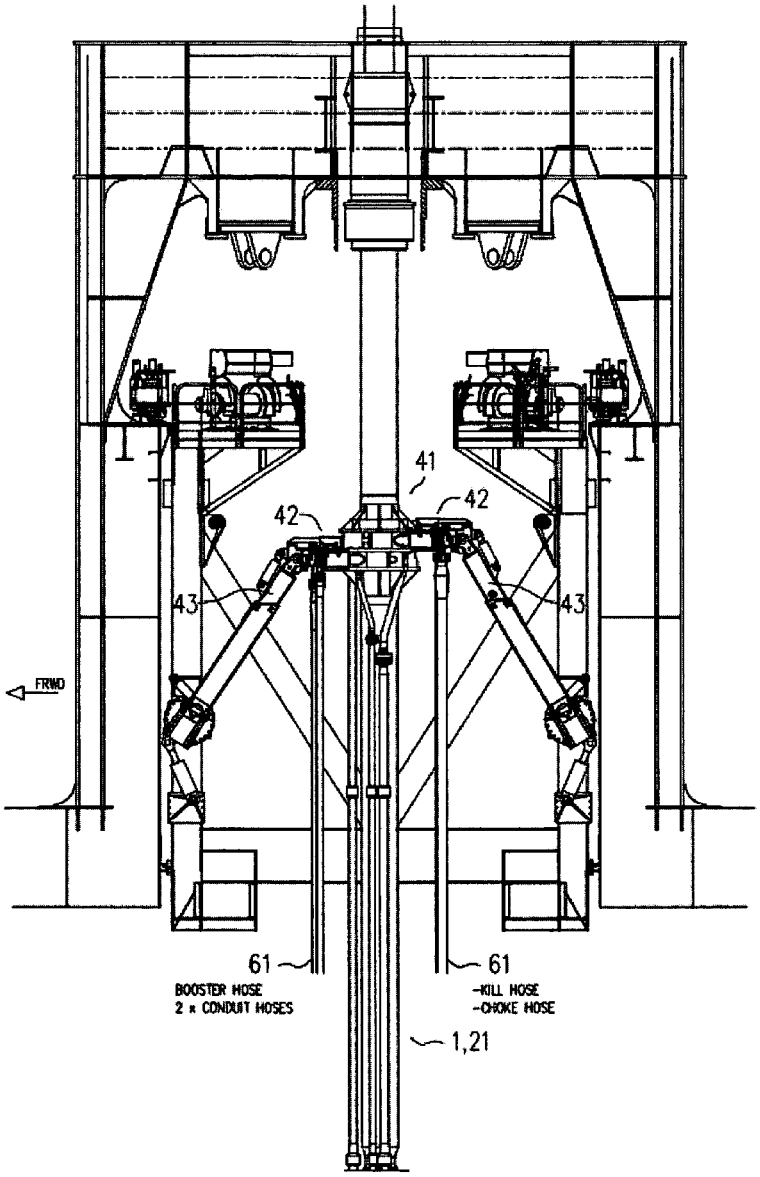

FIG. 10 shows a subsequent step wherein the horizontally directed kill- and choke connector manifolds with their belonging kill- and choke hoses hanging underneath have been displaced inwards in their horizontal directions and have become "stabbed" into the horizontally directed kill- and choke manifold on the riser's slip joint outer barrel. Please note that here the operators stand at a safe distance and observe and control the connection, and stand protected on a fixed platform over the moonpool but well out of reach from possible pendulum motions, and the operators are not subject o any risk of impacts or crushing neither from the riser, hanging hoses nor manipulator arms.

Figure 11:
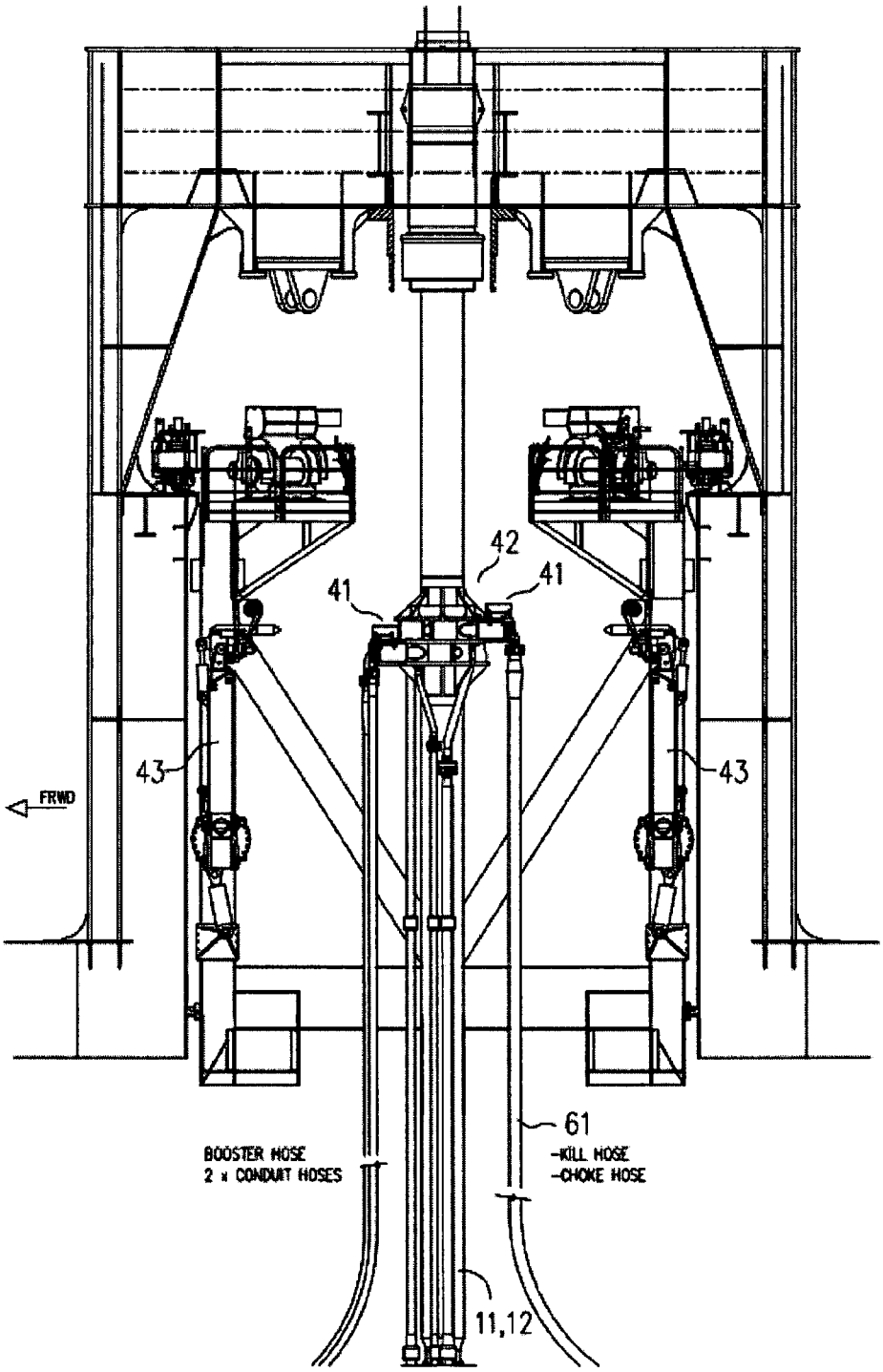

FIG. 11 shows a subsequent step according to the invention wherein a releasable connector mechanism on the manipulator arm's outer end, which hitherto has held the kill- and choke connector manifold with its hoses, now has been released from the connector manifold so as for that to be attached in a fail-safe mode on the riser's kill- and choke manifold. A safe connection has now been established from the riser's kill- and choke lines, via the kill- and choke manifold, the kill- and choke connector manifold, via the kill- and choke hoses, to the platform's on-board kill- and choke manifold.

The further steps comprising lowering the riser pipe for landing the BOP and lowering the riser's load to the tension line compensators and connect the top of the inner barrel to a flex joint and further to a diverter housing, belong to the tasks for the person skilled in the art.

Figure 12:
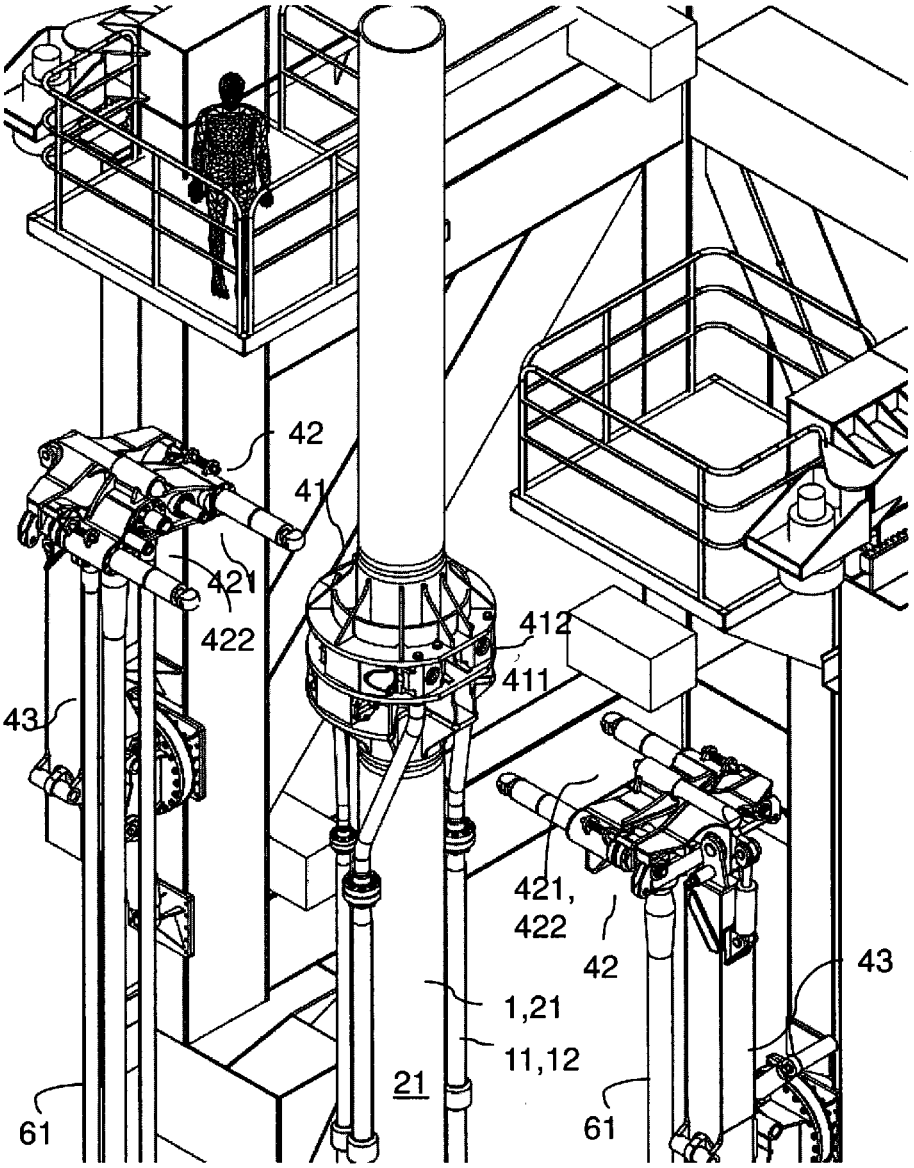

FIG. 12 is an isometric view of the above mentioned embodiment of the invention and corresponds with the cross-section of FIG. 9. The manipulator arms with the connector manifold in a desired elevation are ready and directed for being guided horizontally into engagement with the manifold on the riser's slip joint outer barrel. Here we see the guide pins which are arranged for being guided into guide sleeves of the manifold, which further guide the pipe ends of the connector manifold which home in on the receptacles of the manifold. The guide pins shown here comprise locking heads with profiles which enter locking profiles in the guide sleeves and are rotated and thereby locked, and safeguarded against being opened without energy being supplied. One or more of the pairs of the pipe ends and receptacles may in an alternative embodiment be arranged oppositely. Likewise, the guide pins and the guide sleeves may be arranged oppositely if desired, (but it may be important considering the pipe handling during the assembly- and disassembly operation that no pipe ends extend outside of the flange of the riser). We here see that the manipulator arm is telescoping and provided with links and hydraulics allowing the connector manifold to be displaced when it is held in a desired position and elevation relative to the riser, and that it further, after disconnection, may follow the riser's pendulum movement and possible small vertical movements.

Figure 13:
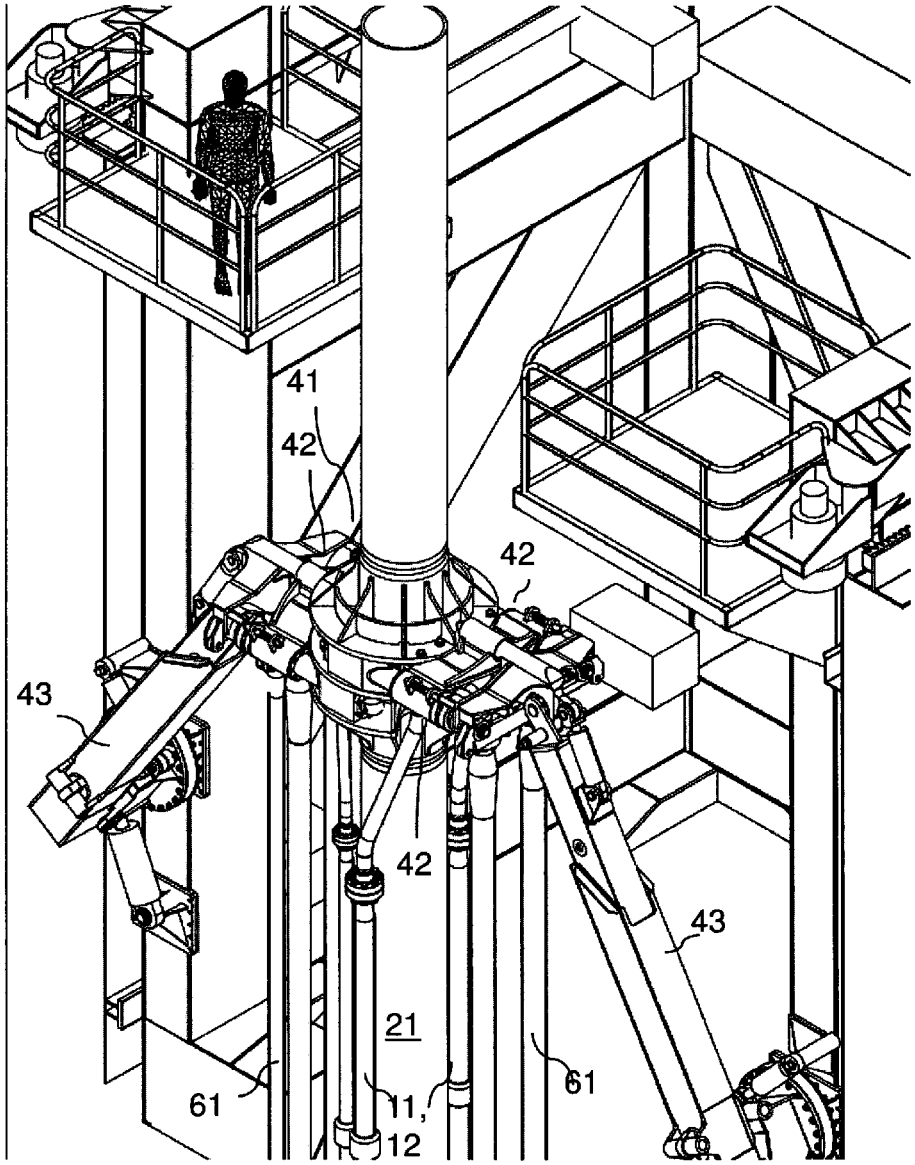

FIG. 13 shows a further step in the embodiment wherein the kill- and choke connector manifold have been stabbed and locked into the kill- and choke manifold of the slip joint outer barrel. The manipulator arms and the releasable connector device will still follow the pendulum movements of the riser.

Figure 14:
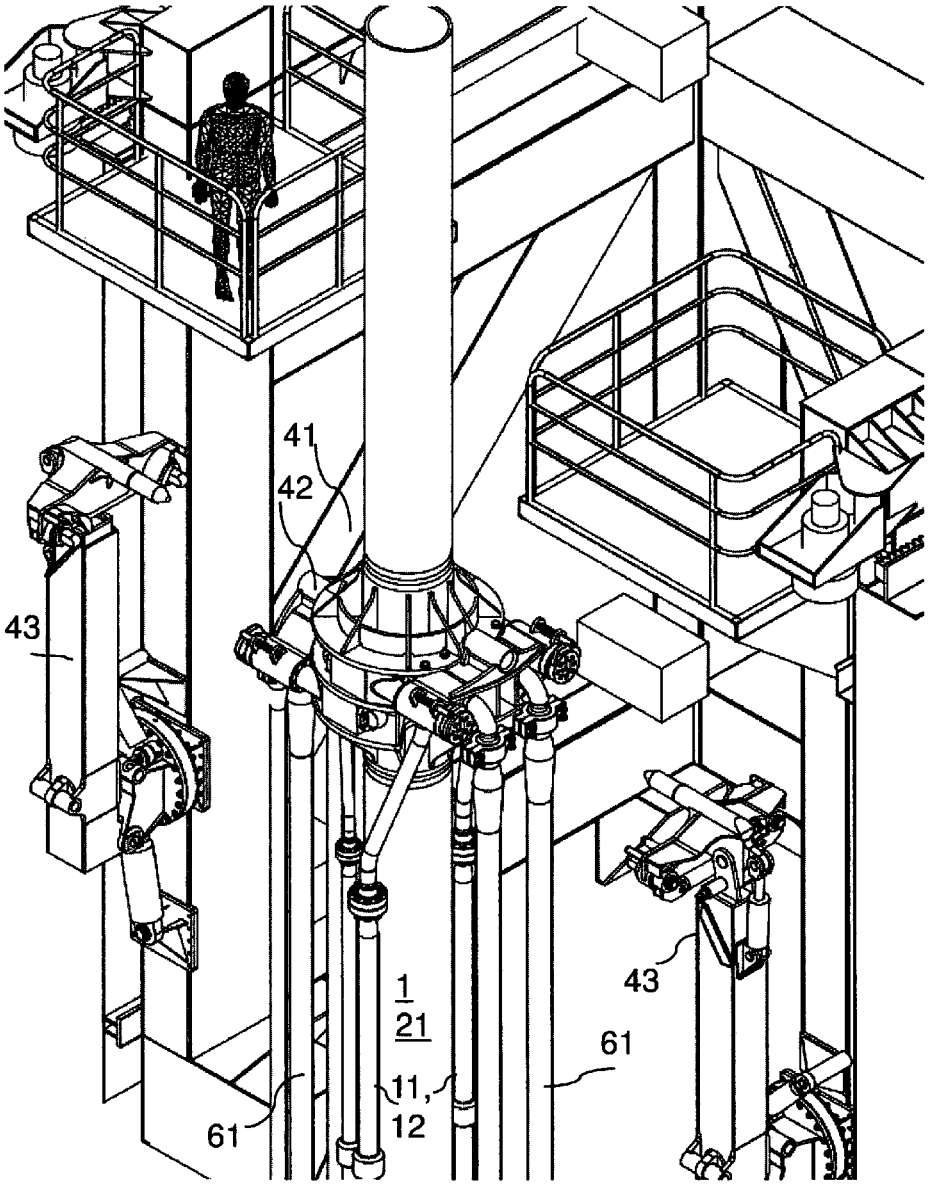

FIG. 14 shown a preliminary latest step wherein the releasable connector mechanism of the manipulator arm has been released in that a connector mechanism guide pin of this has been released from a corresponding connector mechanism guide sleeve of the connector manifold. Here, also guide pin keys of connector mechanism are illustrated, which are arranged for being coupled into the rear end of the guide pins and arranged for operating the locking mechanism of the guide sleeves of the manifold.

Figure 15:
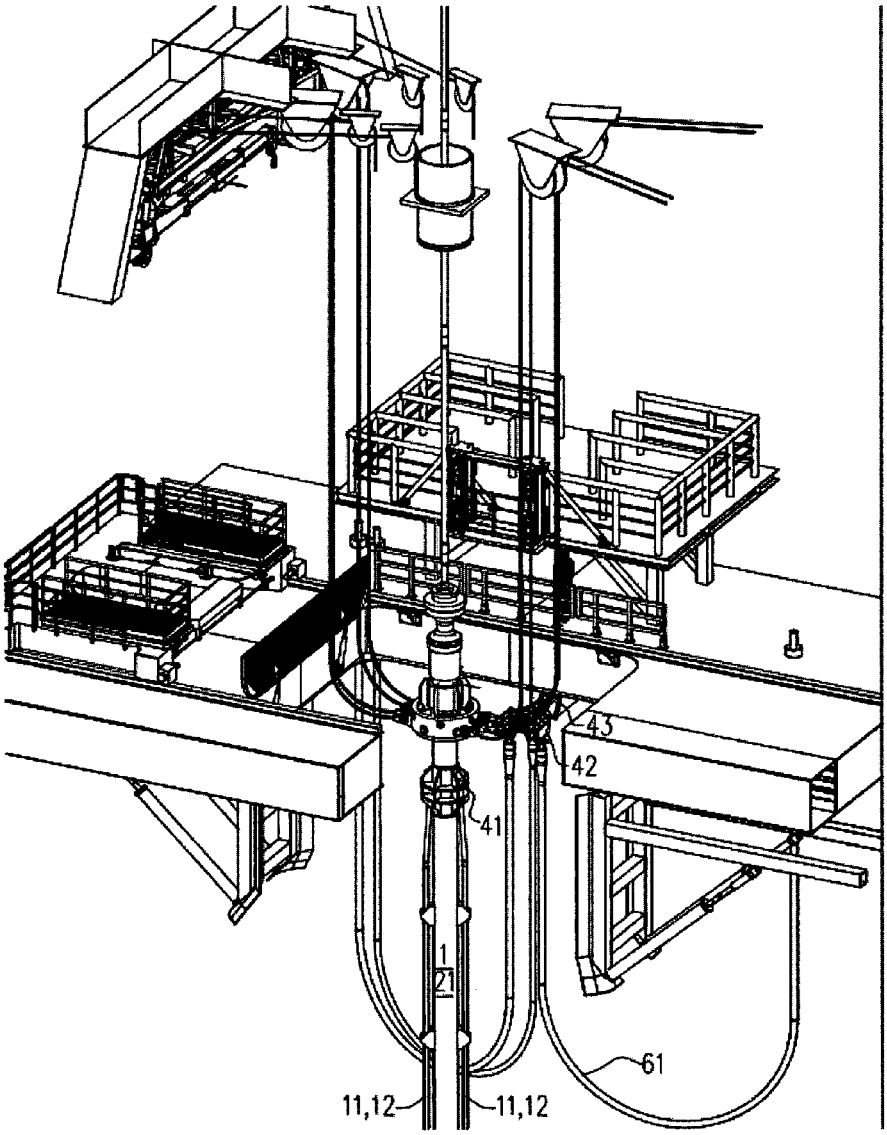

FIG. 15 show an isometric view and part section of another preferred embodiment of the invention wherein the connector manifold has been arranged on a generally horizontally and radially directed manipulator arm assembled in an actuator bracket below the cellar deck below the moonpool. In this drawing the riser is shown hanging from an assembled landing pipe string from the drilling motor in the drilling derrick tower. The tension ring has been assembled on the slip joint and the tensioner lines hang connected in their slack state from the heave compensators via idler sheaves below the drilling deck.

Figure 16:
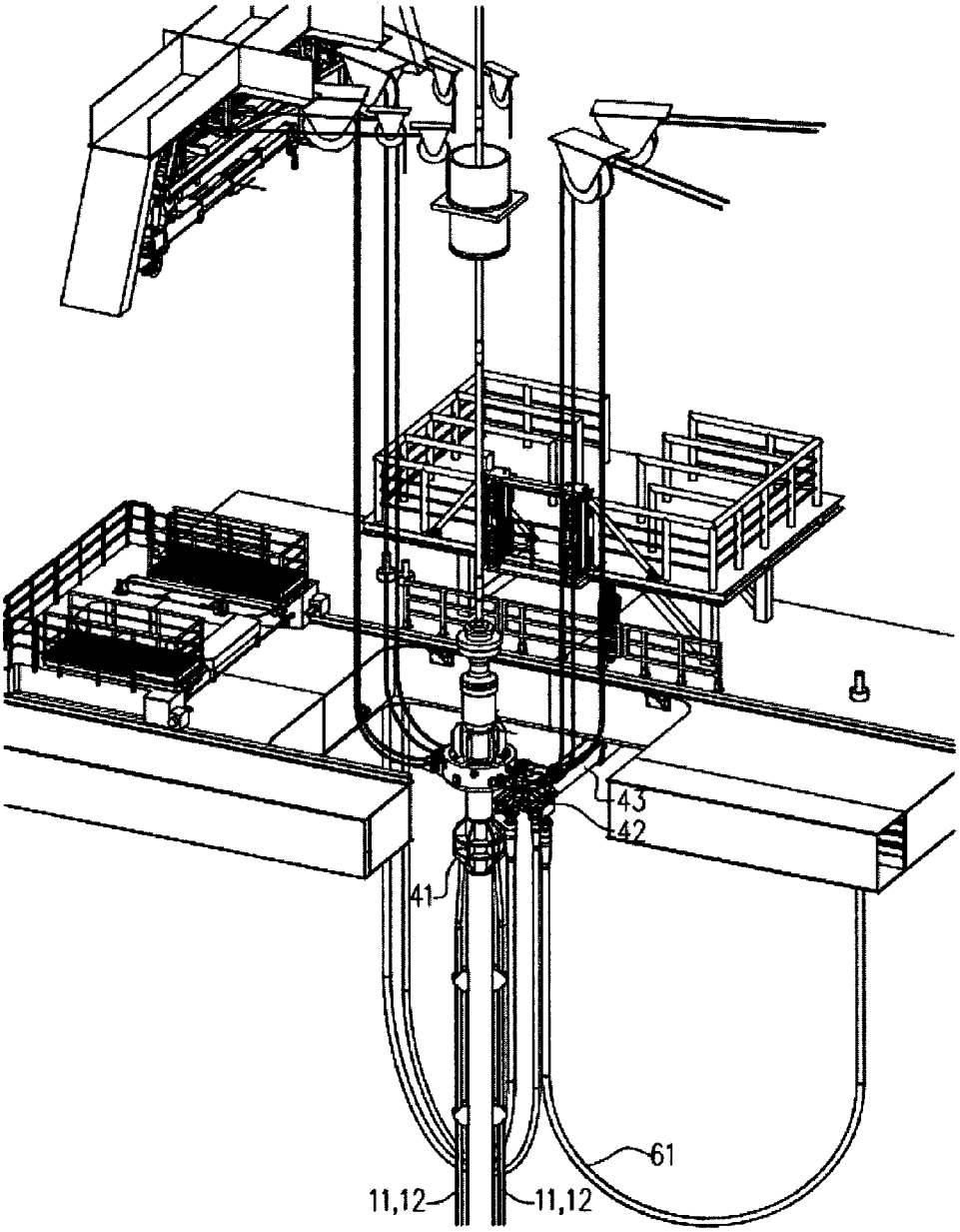

FIG. 16 illustrates the horizontally directed manipulator arm in action pushing the connector manifold inwards in order to "stab" the horizontal kill- and choke manifold of the slip joint outer barrel near the riser's upper end. Kill- and choke lines are shown attached and extending down along the riser.

Figure 17:
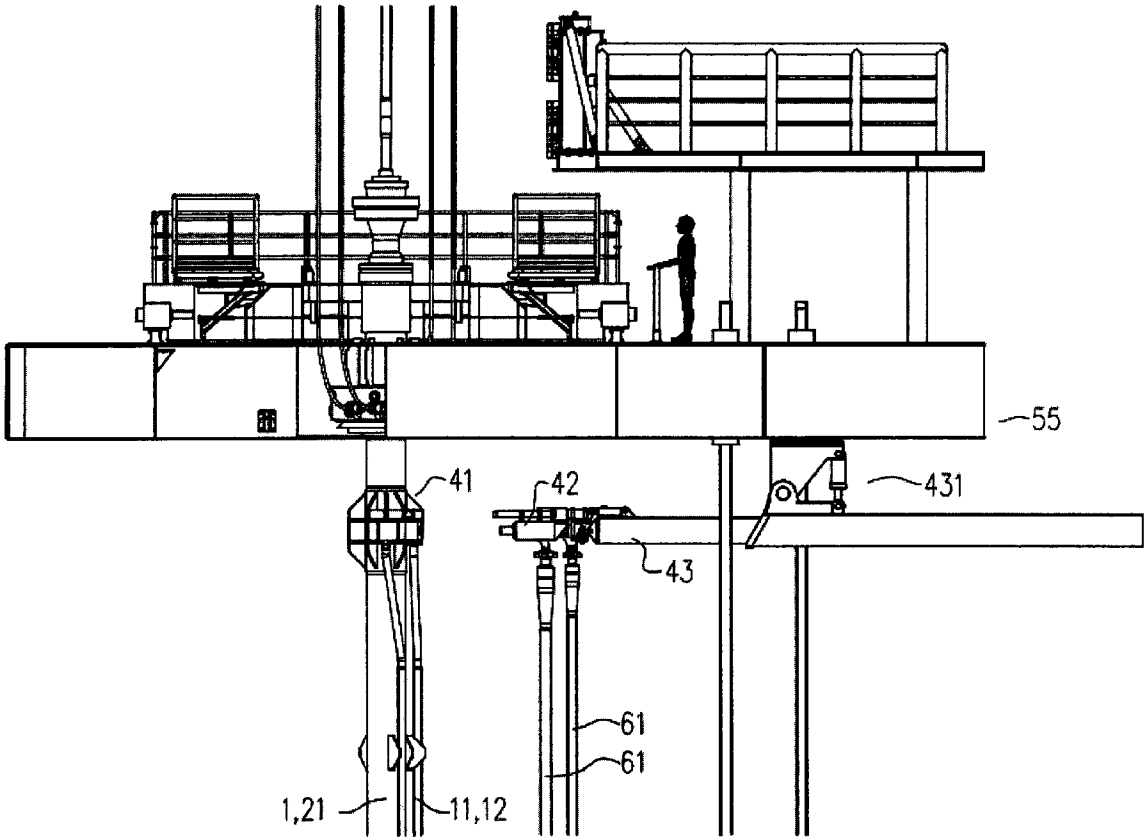

FIG. 17 is a cross-section through and part elevation view of the moonpool and the riser with the slip joint hanging in level with the cellar deck, and with the connector manifold arranged in level with the hanging riser's kill- and choke manifold, generally in the same elevation, prepared for being connected to. A hydraulic actuator for controlling the inclination of the manipulator arm relative to the horizontal is shown, and further is shown an operator which may stand above the moonpool and monitor and control the connecting operation by means of a control panel and i safe distance from the potentially pendulum-moving riser, and above any pendulum-moving kill- or choke hoses.

Figure 18:
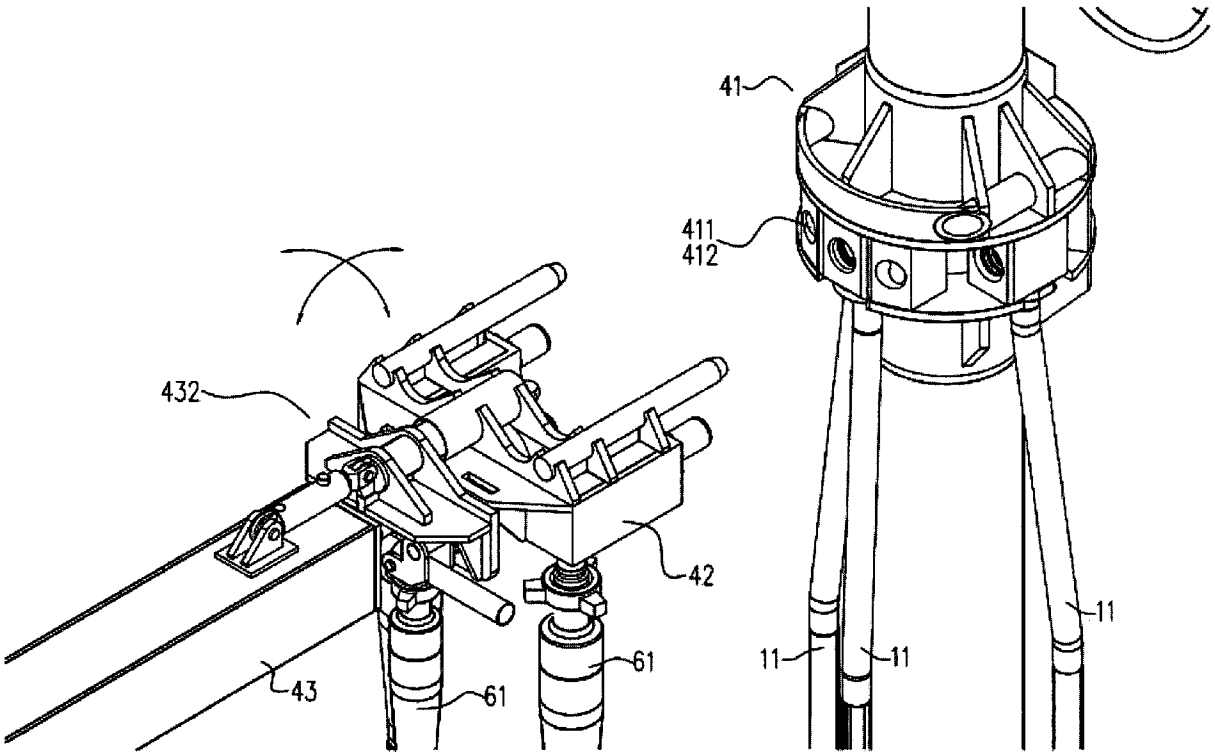

FIG. 18 is an isometric view of this second preferred embodiment of the invention and illustrates the radially inner end of the manipulator arm which holds the releasable connector mechanism in a ball hinge with a spring compensator. The releasable connector mechanism further holds the kill- and choke connector manifold with its kill- and choke hoses. The connector manifold is here directed with the guide pins and the pipe ends towards the kill- and choke mechanism of the riser and its guide sleeves and receptacles.

Figure 19:
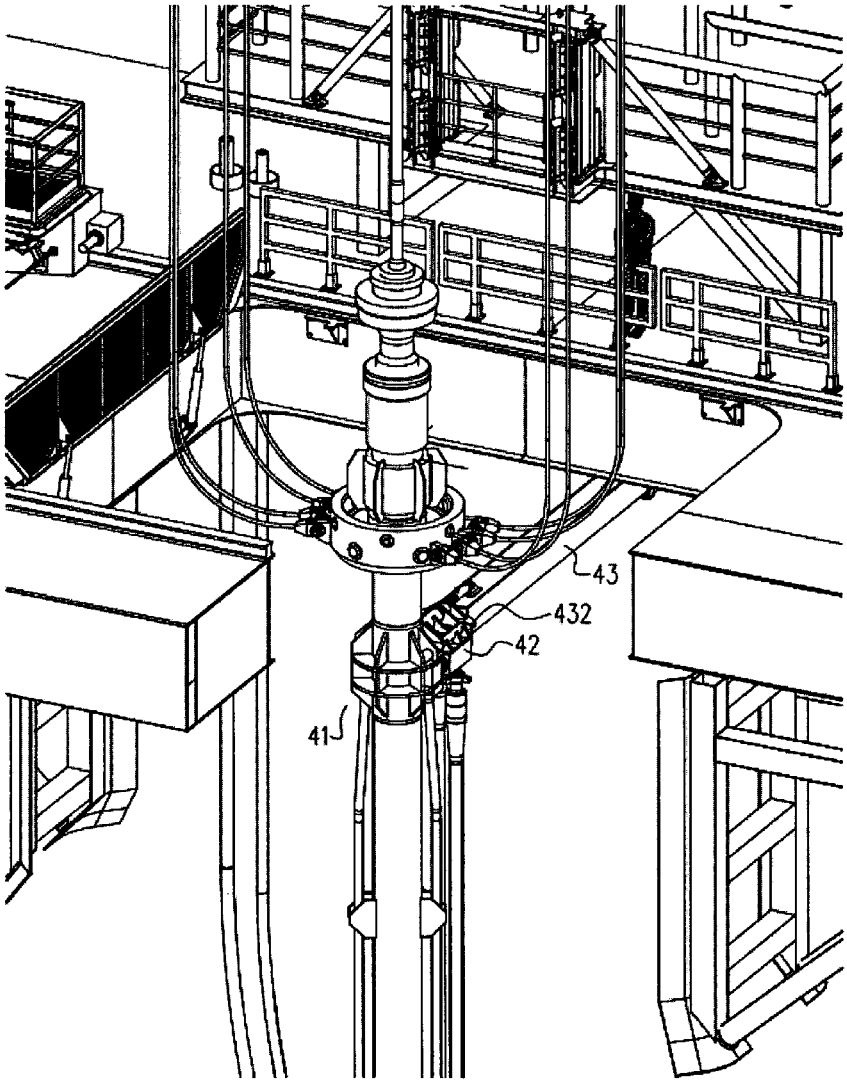

FIG. 19 shows a subsequent step in the interconnecting process wherein the riser still hangs from a top drive and wherein the manipulator arm now has pushed the connector manifold into complete engagement with the kill- and choke manifold of the riser pipe. A kill- and choke connection has now been established between the riser and the BOP on the one side, via the kill- and choke hoses hanging down in a catenary line and turning upwards towards the platform's on-board kill- and choke plant. The BOP is not lowered and landed on the well head yet.

Figure 20:
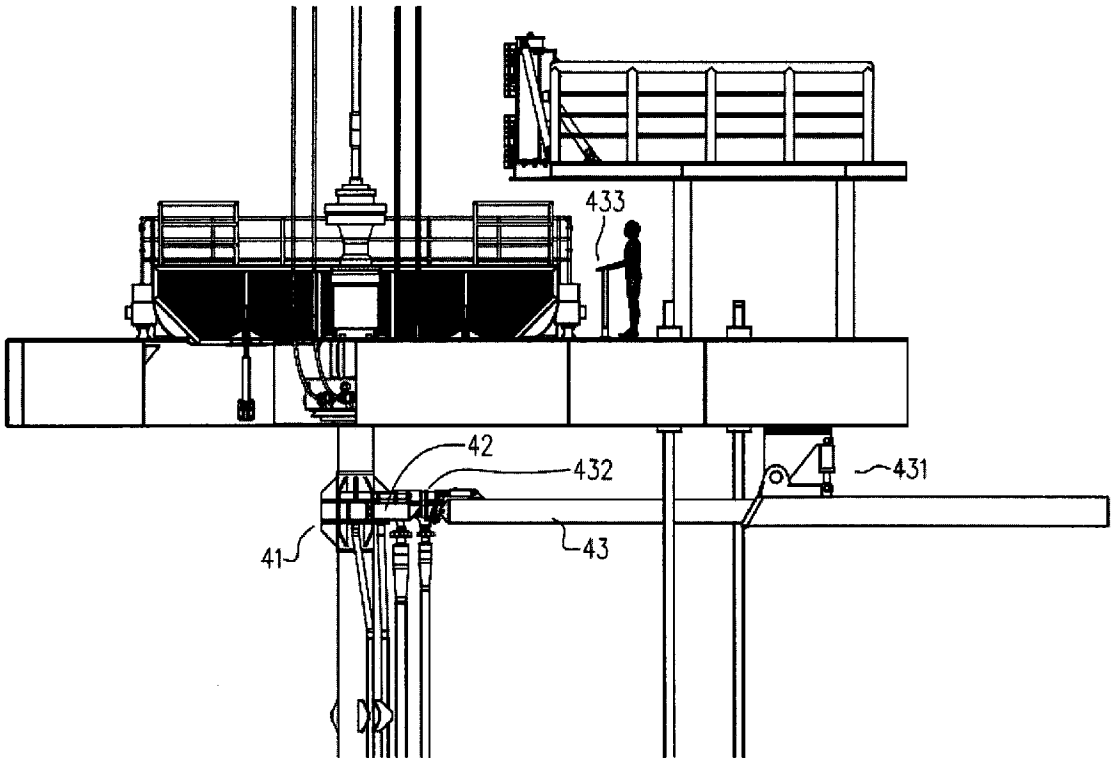

FIG. 20 shows a part section, part elevation view corresponding to FIG. 17, but wherein the connecting manifold has been pushed by the manipulator arm to complete engagement with the manifold on the riser as explained under FIG. 19.

Figure 21:
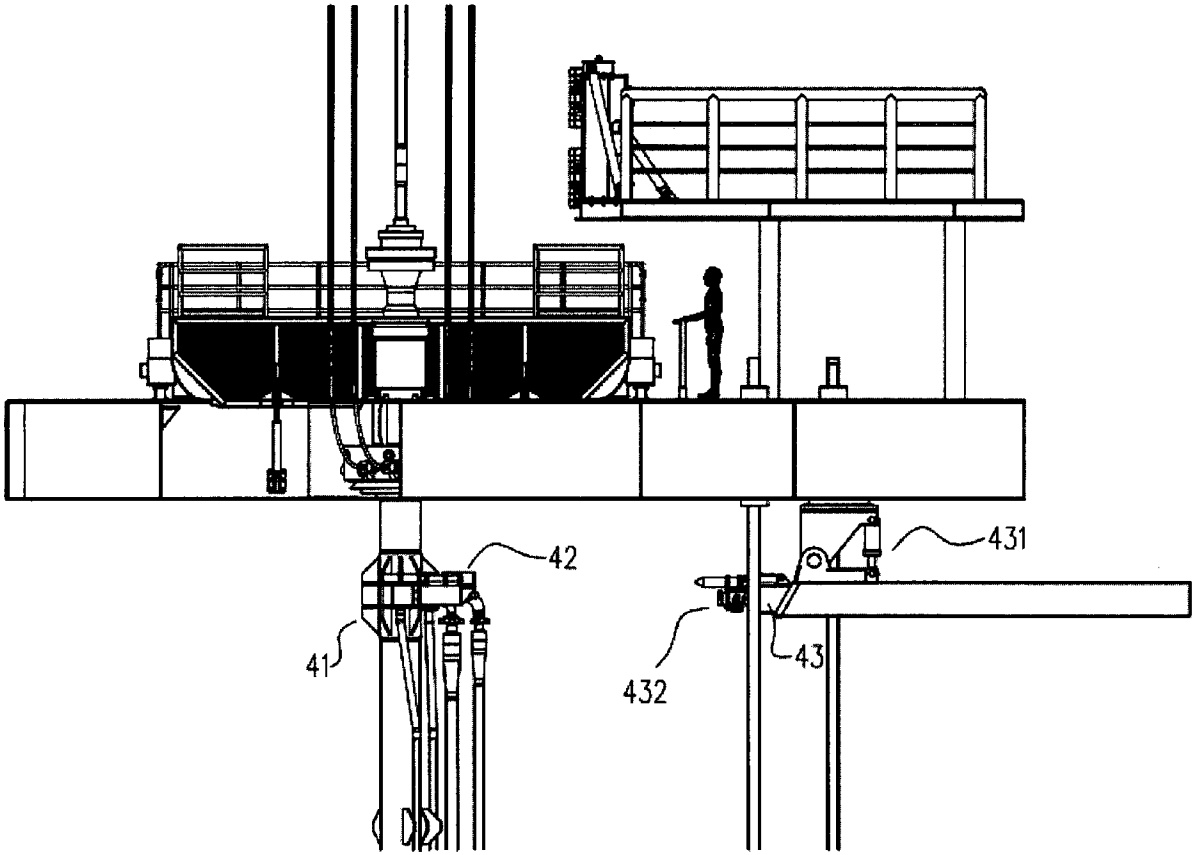

FIG. 21 shows a part section, part elevation view corresponding to FIG. 20, but here with the releasable connector mechanism released from the connector manifold and retracted to a radially outer, riser-remote position, by the manipulator arm. The kill- and choke hoses now hang from the connector manifold. When the connector manifold is to be disconnected from the riser, the riser must be elevated to the same level, and the process be reversed.

Figure 22:
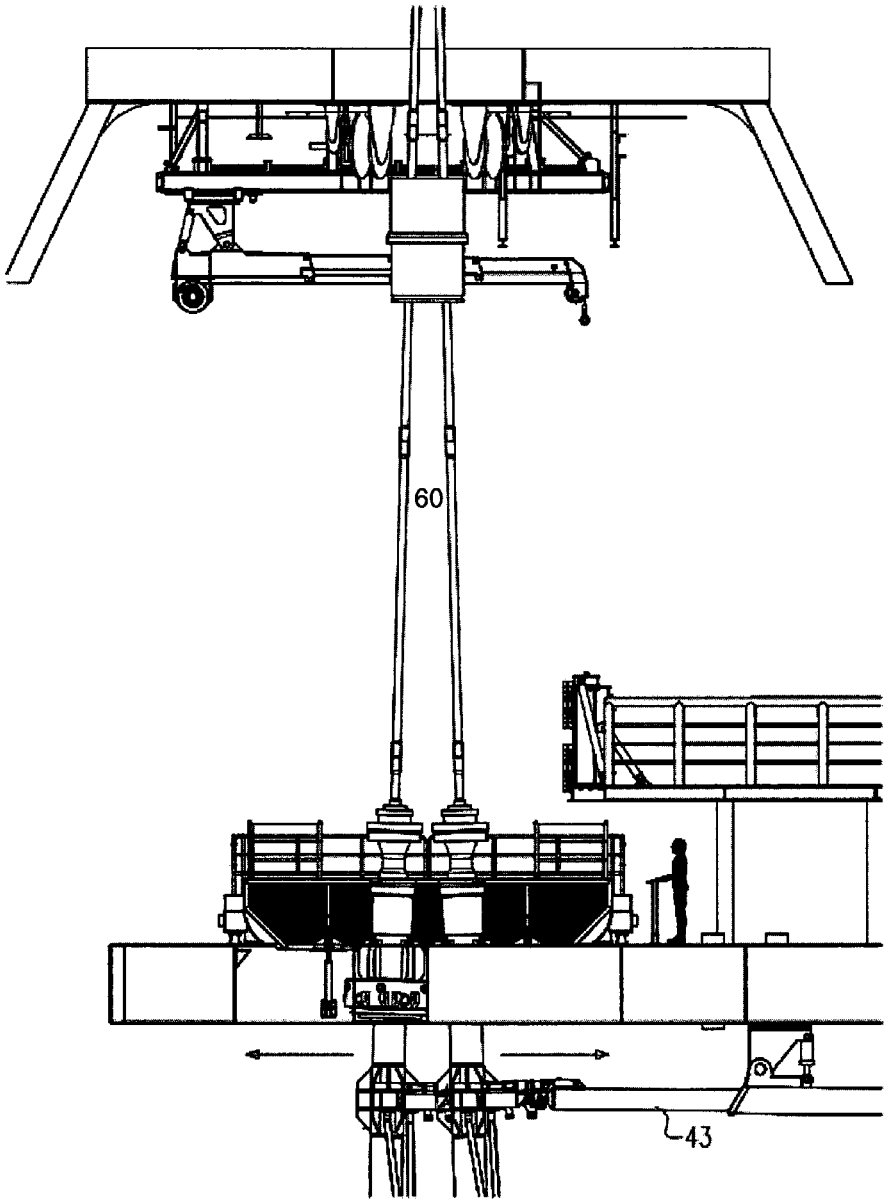

FIG. 22 is a part section, part elevation view, through the drilling deck in the upper part of the drawing, with the diverter sleeve which openly encircles the landing string, of which said landing string in a lower level holds the slip joint outer barrel (with a collapsed inner barrel). Below the cellar deck here is illustrated that the manipulator arm holds the connector manifold in a connected state to the kill- and choke-manifold of the riser, and that the ball link on the manipulator arm's end and the telescope function and the linking of the manipulator arm's end allows the riser to make pendulum movements in its connected state. This flexibility allows, when an interconnection has been achieved, that the operation both for connecting (and later disconnecting) may be conducted in an orderly and controlled manner without risk of damaging the equipment or hurting any personnel. This may also allow to extend the weather window for when to commence, conduct or continue riser operations and thus provide an economical advantage for the drilling rig in addition to the time saving that the invention's method provides to the operation.

Figure 23:
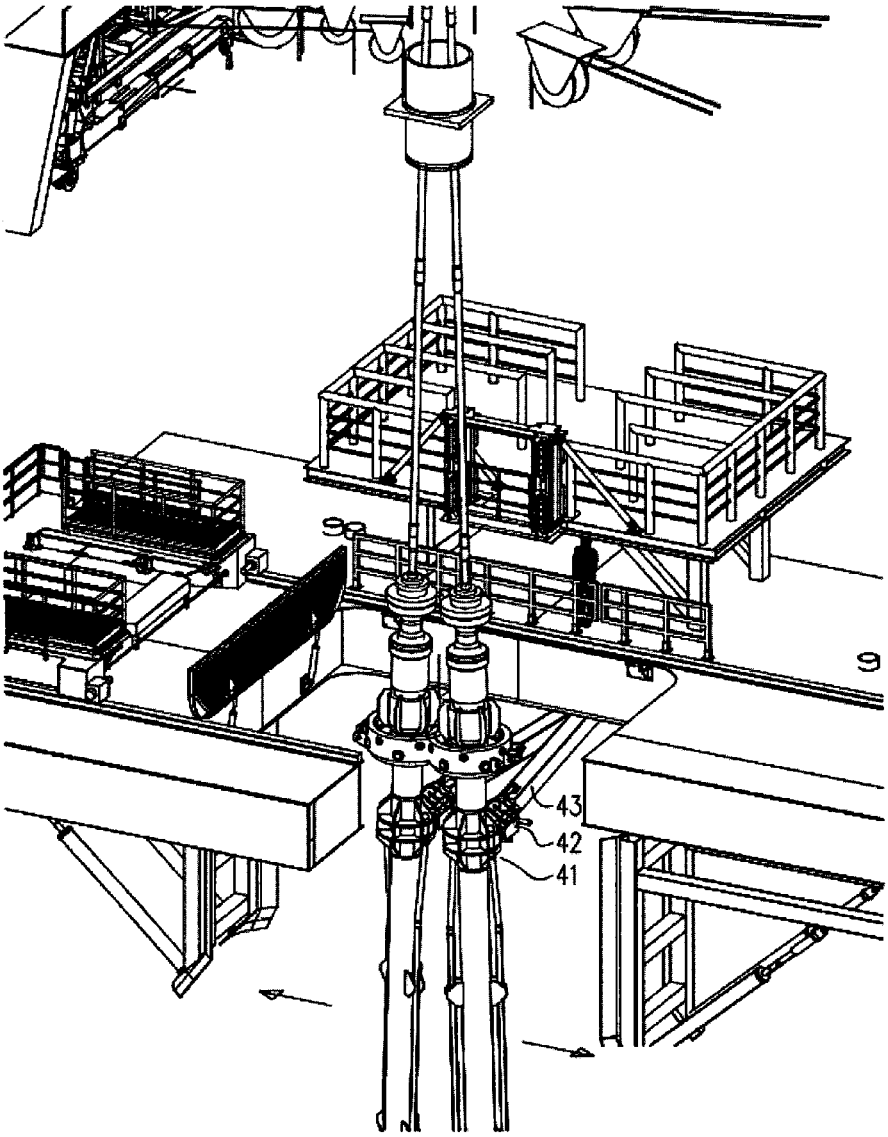

FIG. 23 is an isometric view and part section of the moonpool and with the landing string hanging from the top drive (not illustrated) and demonstrating that the horizontal manipulator arm is flexibly mounted also about a vertical axis and allows the riser to make pendulum motions athwart of the manipulator arm's extension. By the moment that the manipulator arm has brought the connector manifold in a secure engagement with the kill- and choke manifold, the hydraulics of the manipulator arm may be set to idle so as for enabling the manipulator arm to follow the riser's movements, and not activate the hydraulic system until the releasable connector device of the manipulator arm shall be disconnected and retracted on the manipulator arm.

Figure 24:
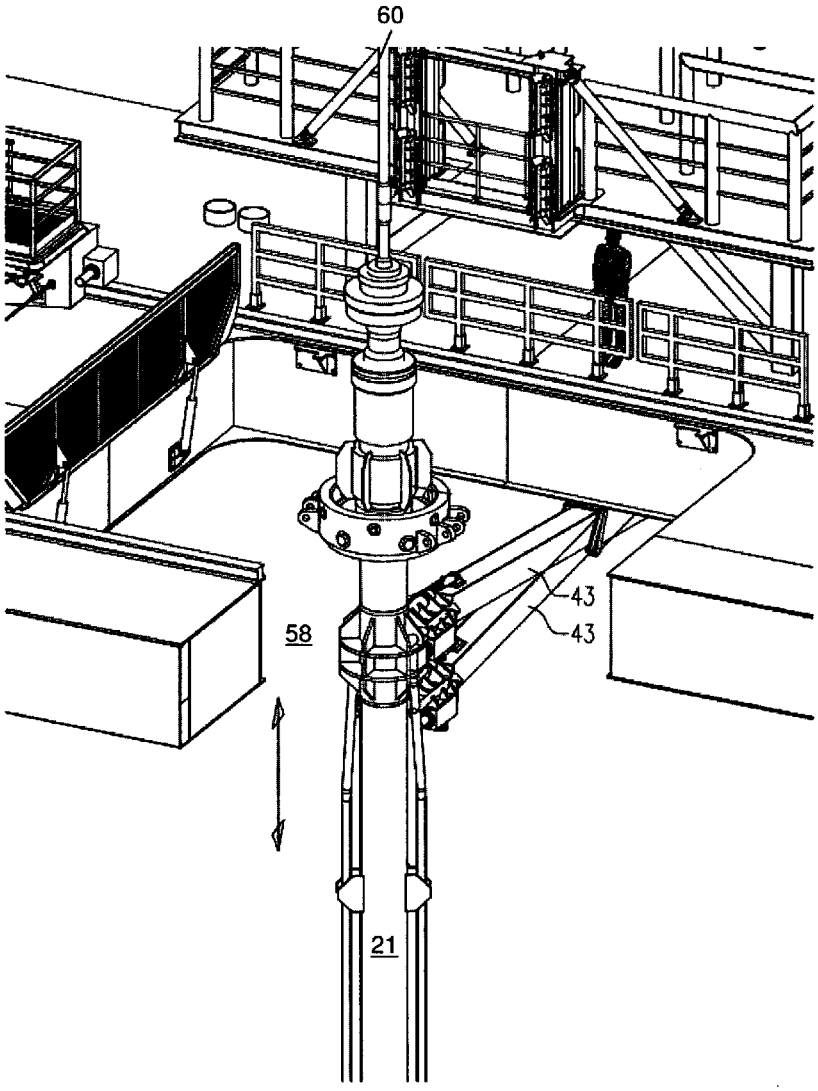

FIG. 24 is an isometric corresponding view as FIG. 23, but shows the manipulator arm's freedom to be pivoted about a horizontal axis in the bracket and thus follow a certain short variation of the riser's elevation in its connected state.

Figure 25:
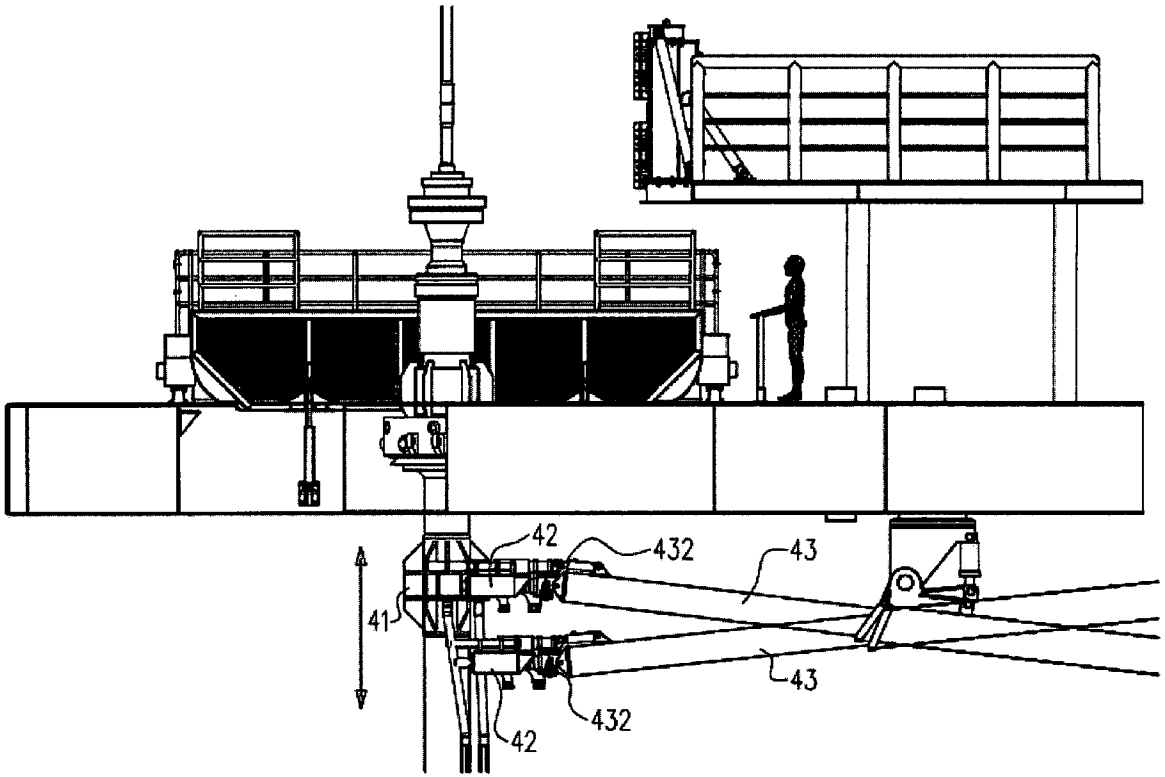

FIG. 25 is a section and partial view through the moonpool and shows the same feature as shown in FIG. 24 wherein the manipulator arm is arranged for being pivoted in its bracket relative to the horizontal plane in order to allow a certain minimal variation for the elevation of the kill- and choke manifold.

DESCRIPTION OF EMBODIMENTS OF THE INVENTION

FIG. 9 illustrates an embodiment of the invention. The drawing is a cross-section through a drilling platform through a central portion of the drilling deck and auxiliary platforms below the drilling deck, and through the cellar deck. The drawing is also a cross-section through a moonpool which extends athwart of the vessel and wherein is arranged a skid for a BOP which may be run in from the side and in under the opening in the drilling deck. The riser here hangs from the top drive (not shown) and down through the opening in the drilling deck and the diverter housing and extends further down to the BOP which hangs in a desired elevation above the wellhead. According to this embodiment of the invention, horizontally directed kill- and choke connector manifolds, with kill- and choke hoses from the platform's side, are arranged on the skid and arranged for being guided in into two corresponding and oppositely directed horizontally directed kill- and choke manifolds on the riser's slip joint outer barrel. In this rather concrete case, the kill- and choke connector manifold in the right part of the drawing and a corresponding connecting manifold with booster- and two conduit hoses is shown in the left part of the drawings. The extensive guide pins of the connecting manifolds dominate the image and extend inwardly towards apertures of corresponding guiding sleeves of the kill- and choke manifold on the slip joint outer barrel, and should not be confused with connecting pipe ends and receptacles which will be shown in between those on subsequent Figures, please see FIG. 12.

The invention accordingly is a connector device for kill- and choke lines (11, 12) between a riser (1) and a floating drilling platform, comprising the following features:

- a slip joint (2) on top of the riser (1) comprising an outer barrel (21),
- a kill- and choke manifold (6) arranged on the platform and provided with flexible kill- and choke hoses (61) to the slip joint's (2) outer barrel (21) The new features by the invention comprise
- the slip joint's outer barrel (21) is provided with a horizontally directed kill- and choke-manifold (41) with horizontally directed pipe ends (411, 412), and
- the kill- and choke hoses (61) are provided with a kill- and choke connector manifold (42) with horizontally directed receptacles (421, 422) arranged for receiving the horizontally directed pipe ends (411, 412),
- wherein the kill- and choke connector manifold (42) is arranged on a manipulator arm (43) extending from the drilling platform's (5) structure, and arranged for being moved generally in a horizontal direction for connecting the connector manifold (42) to the manifold (41). One may in this way establish connections between the kill- and choke lines (11,12) at the riser and the kill and choke lines (61,62) from the kill- and choke manifold (6) at the rig (5).

In a preferred embodiment of the invention the connector device may have two or more, horizontally directed kill- and choke connector manifolds (42) which are directed for being connected to two or more corresponding oppositely directed kill- and choke-manifolds (41) arranged on either sides of the riser (1).

According to a preferred embodiment of the invention the manipulator arm (43) may be hung up in an actuator mounting bracket (431) by a cellar deck (55) and aside of a moonpool extending generally in a horizontal direction and extending towards the riser (1), and arranged for moving the connector manifold (42) into engagement with the manifold (41).

According to a further preferred embodiment of the invention the manipulator arm (43) is provided with a releasable connecting mechanism (432) for said connector manifold (42) arranged for releasing said manipulator arm (43) from said connector manifold (42) after being fail safe connected to said manifold (41).

According to another preferred embodiment of the invention the actuator mounting bracket (431) may be provided with a control device (433) arranged for [being operated by] an operator at safe distance from said riser (1) and arranged for controlling the actuator mounting bracket's movements of the connector manifold (42) upon commands from said operator.

FIG. 10 shows a subsequent step wherein the horizontally directed kill- and choke connector manifolds with their belonging kill- and choke hoses hanging underneath have been displaced inwards in their horizontal directions and have become "stabbed" into the horizontally directed kill- and choke manifold on the riser's slip joint outer barrel. Please note that here the operators stand at a safe distance and observe and control the connection, and stand protected on a fixed platform over the moonpool but well out of reach from possible pendulum motions, and the operators are not subject o any risk of impacts or crushing neither from the riser, hanging hoses nor manipulator arms.

FIG. 11 shows a subsequent step according to the invention wherein a releasable connector mechanism on the manipulator arm's outer end, which hitherto has held the kill- and choke connector manifold with its hoses, now has been released from the connector manifold so as for that to be attached in a fail-safe mode on the riser's kill- and choke manifold. A safe connection has now been established from the riser's kill- and choke lines, via the kill- and choke manifold, the kill- and choke connector manifold, via the kill- and choke hoses, to the platform's on-board kill- and choke manifold.

The further steps comprising lowering the riser pipe for landing the BOP and lowering the riser's load to the tension line compensators and connect the top of the inner barrel to a flex joint and further to a diverter housing, are tasks for the person skilled in the art.

FIG. 12 is an isometric view of the above mentioned embodiment of the invention and corresponds with the cross-section of FIG. 9. The manipulator arms with the connector manifold in a desired elevation are ready and directed for being guided horizontally into engagement with the manifold on the riser's slip joint outer barrel. Here we see the guide pins which are arranged for being guided into guide sleeves of the manifold, which further guide the pipe ends of the connector manifold which home in on the receptacles of the manifold. The guide pins shown here comprise locking heads with profiles which enter locking profiles in the guide sleeves and are rotated and thereby locked, and safeguarded against being opened without energy being supplied. One or more of the pairs of the pipe ends and receptacles may in an alternative embodiment be arranged oppositely. Likewise, the guide pins and the guide sleeves may be arranged oppositely if desired, (but it may be important considering the pipe handling during the assembly- and disassembly operation that no pipe ends extend outside of the flange of the riser). We here see that the manipulator arm is telescoping and provided with links and hydraulics allowing the connector manifold to be displaced when it is held in a desired position and elevation relative to the riser, and that it further, after disconnection, may follow the riser's pendulum movement and possible small vertical movements.

FIG. 13 shows a further step in the embodiment wherein the kill- and choke connector manifold have been stabbed and locked into the kill- and choke manifold of the slip joint outer barrel. The manipulator arms and the releasable connector device will still follow the pendulum movements of the riser.

FIG. 14 shown a preliminary latest step wherein the releasable connector mechanism of the manipulator arm has been released in that a connector mechanism guide pin of this has been released from a corresponding connector mechanism guide sleeve of the connector manifold. Here, also guide pin keys of connector mechanism are illustrated, which are arranged for being coupled into the rear end of the guide pins and arranged for operating the locking mechanism of the guide sleeves of the manifold.

FIG. 15 show an isometric view and part section of another preferred embodiment of the invention wherein the connector manifold has been arranged on a generally horizontally and radially directed manipulator arm assembled in an actuator bracket below the cellar deck below the moonpool. In this drawing the riser is shown hanging from an assembled landing pipe string from the drilling motor in the drilling derrick tower. The tension ring has been assembled on the slip joint and the tensioner lines hang connected in their slack state from the heave compensators via idler sheaves below the drilling deck.

FIG. 16 illustrates the horizontally directed manipulator arm in action pushing the connector manifold inwards in order to "stab" the horizontal kill- and choke manifold of the slip joint outer barrel near the riser's upper end. Kill- and choke lines are shown attached and extending down along the riser.

FIG. 17 is a cross-section through and part elevation view of the moonpool and the riser with the slip joint hanging in level with the cellar deck, and with the connector manifold arranged in level with the hanging riser's kill- and choke manifold, generally in the same elevation, prepared for being connected to. A hydraulic actuator for controlling the inclination of the manipulator arm relative to the horizontal is shown, and further is shown an operator which may stand above the moonpool and monitor and control the connecting operation by means of a control panel and i safe distance from the potentially pendulum-moving riser, and above any pendulum-moving kill- or choke hoses.

FIG. 18 is an isometric view of this second preferred embodiment of the invention and illustrates the radially inner end of the manipulator arm which holds the releasable connector mechanism in a ball hinge with a spring compensator. The releasable connector mechanism further holds the kill- and choke connector manifold with its kill- and choke hoses. The connector manifold is here directed with the guide pins and the pipe ends towards the kill- and choke mechanism of the riser and its guide sleeves and receptacles.

FIG. 19 shows a subsequent step in the interconnecting process wherein the riser still hangs from a top drive and wherein the manipulator arm now has pushed the connector manifold into complete engagement with the kill- and choke manifold of the riser pipe. A kill- and choke connection has now been established between the riser and the BOP on the one side, via the kill- and choke hoses hanging down in a catenary line and turning upwards towards the platform's on-board kill- and choke plant. The BOP is not lowered and landed on the well head yet.

FIG. 20 shows a part section, part elevation view corresponding to FIG. 17, but wherein the connecting manifold has been pushed by the manipulator arm to complete engagement with the manifold on the riser as explained under FIG. 19.

FIG. 21 shows a part section, part elevation view corresponding to FIG. 20, but here with the releasable connector mechanism released from the connector manifold and retracted to a radially outer, riser-remote position, by the manipulator arm. The kill- and choke hoses now hang from the connector manifold. When the connector manifold is to be disconnected from the riser, the riser must be elevated to the same level, and the process be reversed.

FIG. 22 is a part section, part elevation view, through the drilling deck in the upper part of the drawing, with the diverter sleeve which openly encircles the landing string, of which said landing string in a lower level holds the slip joint outer barrel (with a collapsed inner barrel). Below the cellar deck here is illustrated that the manipulator arm holds the connector manifold in a connected state to the kill- and choke-manifold of the riser, and that the ball link on the manipulator arm's end and the telescope function and the linking of the manipulator arm's end allows the riser to make pendulum movements in its connected state. This flexibility allows, when an interconnection has been achieved, that the operation both for connecting (and later disconnecting) may be conducted in an orderly and controlled manner without risk of damaging the equipment or hurting any personnel. This may also allow to extend the weather window for when to commence, conduct or continue riser operations and thus provide an economical advantage for the drilling rig in addition to the time saving that the invention's method provides to the operation.

FIG. 23 is an isometric view and part section of the moonpool and with the landing string hanging from the top drive (not illustrated) and demonstrating that the horizontal manipulator arm is flexibly mounted also about a vertical axis and allows the riser to make pendulum motions athwart of the manipulator arm's extension. By the moment that the manipulator arm has brought the connector manifold in a secure engagement with the kill- and choke manifold, the hydraulics of the manipulator arm may be set to idle so as for enabling the manipulator arm to follow the riser's movements, and not activate the hydraulic system until the releasable connector device of the manipulator arm shall be disconnected and retracted on the manipulator arm.

FIG. 24 is an isometric corresponding view as FIG. 23, but shows the manipulator arm's freedom to be pivoted about a horizontal axis in the bracket and thus follow a certain short variation of the riser's elevation in its connected state.

FIG. 25 is a section and partial view through the moonpool and shows the same feature as shown in FIG. 24 wherein the manipulator arm is arranged for being pivoted in its bracket relative to the horizontal plane in order to allow a certain minimal variation for the elevation of the kill- and choke manifold.

COMPONENTS LIST

1 Riser
635 11,12 Kill/choke lines along the riser
13 Riser section
131 lover end flange
132 upper end flange
111,112 vertical pipe ends at kill/choke line's upper end flange 132 640 115
116 vertical receptacles at kill/choke lines at lower flange 131
2 Slip joint
21 slip joint outer barrel; a lower, static part (related to the riser) of the slip joint manifold; slip joint 645 manifold main part
645 211,212 vertical pipe ends at kill/choke lines at the slip joint's outer barrel 21
22 slip joint inner barrel; an inner slipping upper pipe ends in a slip joint arranged for heave along the bore deck
23 vertical slip joint kill/choke manifold according to prior art 24
3 Riser tensioner ring at lower static part of the slip joint manifold which hangs in the riser from a tension line 31 from a tensioner wire compensator 32 at the rig 5 31 tension lines
32 tensioner wire compensator
4 New: Horizontal slip joint manifold
41 New: A horizontally directed kill/choke manifold at the static part of slip joint 2, slip joint inner barrel 21
660 411,412 New horizontally directed kill/choke pipe ends at horizontal kill/choke manifold 41 at static part 21 of the slip joint

421, 422 New horizontally directed kiln/choke receptacles at horizontal manifold 42

42 New: horizontally directed kill/choke connection manifold is generally hung up at the manipulator arm

43 in the platform's structure and arranged for moving horizontal into the horizontally directed kill/choke manifold at the inner barrel (21) of the slip joint.

43: New: A manipulator arm arranged for to carry the horizontal manifold

431 Actuator hang up arrangement arranged to move the manipulator arm with the horizontal connection manifold (42) towards the riser (1)

670 432 Releasable connection mechanism between the manipulator arm (43) and the connection manifold (42).

433 Regulator arranged to control the movement of the actuator arrangement.

5 Floating platform or drilling wessel drilling platform 51 comprising

52 drilling rig/Ram Rig drilling rig

53 drawworks/crown block/spreader (if Ram Rig) in the drilling rig 52 54

55 drill floor

56 drill floor's ??? to hold the riser lines

57 ??? under drill floor 55 to hold the riser line 58 moonpool in the cellar deck

59 skid/slide along the moonpool to hold and move e.g BOP, riser pipe, Xmas tree, casing pipe lines etc.

60 landing line

6 kill/choke manifold at the rig

61,62 flexible kill/choke hosing from kill/choke manifi\old to kill/choke slip joint outer barrel (21) manifold (41)

The invention claimed is:

1. A connector device for kill and choke lines between a riser and a floating drilling platform, comprising the following features:

a slip joint on top of said riser comprising an outer barrel, a kill and choke manifold arranged on said platform and provided with flexible kill and choke hoses to said slip joint's outer barrel, wherein said slip joint's outer barrel is provided with a horizontally directed kill and choke manifold with horizontally directed pipe ends, and said kill- and choke hoses are provided with a kill and choke connector manifold with horizontally directed receptacles arranged for receiving said horizontally directed pipe ends, wherein said kill and choke connector manifold is arranged on a manipulator arm extending from said drilling platform's structure, and arranged for being moved generally in a horizontal direction for connecting said connector manifold to said horizontally directed kill and choke manifold.

2. The connector device according to claim 1, wherein the number of said horizontally directed kill and choke connector manifolds is two or more, and that they are directed for being connected to two or more corresponding oppositely directed kill and choke manifolds arranged on either sides of said riser.

3. The connector device according to claim 1, wherein said manipulator arm is hung up in an actuator mounting bracket by a cellar deck and aside of a moonpool extending generally in a horizontal direction and extending towards said riser, and arranged for moving said connector manifold into engagement with said horizontally directed kill and choke manifold.

4. The connector device according to claim 1, wherein said manipulator arm is provided with a releasable connecting mechanism for said connector manifold arranged for releasing said manipulator arm from said connector manifold after being fail safe connected to said horizontally directed kill and choke manifold.

5. The connector device according to claim 3, wherein said actuator mounting bracket is provided with a control device arranged for being operated by an operator at safe distance from said riser and arranged for controlling the actuator mounting bracket's movements of the connector manifold upon commands from said operator.

6. The connector device of claim 3, wherein said manipulator arm is provided with tension bolts arranged for fail-safe holding of said connector manifold against said horizontally directed kill and choke manifold.

7. The connector device of claim 3, wherein said connector manifold is provided with guide pins and said horizontally directed kill and choke manifold is provided with corresponding guide rails or guide sleeves arranged for roughly guiding the connection between said connector manifold and said horizontally directed kill and choke manifold.

8. The connector device of claim 3, wherein said manipulator arms are arranged on a skid arranged for being sled into place in the moonpool and for being pulled back from the moonpool after use.

9. The connector device of claim 8, wherein said manipulator arms on said skid are arranged generally upright.

* * * * *

UNITED STATES PATENT AND TRADEMARK OFFICE

CERTIFICATE OF CORRECTION

PATENT NO. : 8,875,793 B2
APPLICATION NO. : 13/508762
DATED : November 4, 2014
INVENTOR(S) : Øystein Christensen et al.

It is certified that error appears in the above-identified patent and that said Letters Patent is hereby corrected as shown below:

ON THE TITLE PAGE:

At item (73), Assignee, change "SRI Sports Limited, Kobe (JP)" to --Future Production, Kristiansand (NO)--.

Signed and Sealed this
Eighteenth Day of August, 2015

Michelle K. Lee

Michelle K. Lee
*Director of the United States Patent and Trademark Office*

UNITED STATES PATENT AND TRADEMARK OFFICE

CERTIFICATE OF CORRECTION

PATENT NO. : 8,875,793 B2
APPLICATION NO. : 13/508762
DATED : November 4, 2014
INVENTOR(S) : Christensen et al.

It is certified that error appears in the above-identified patent and that said Letters Patent is hereby corrected as shown below:

TITLE PAGE:

Item [73], Assignee, "Future Production, Kristiansand (NO)" (as corrected to read in the Certificate of Correction issued August 11, 2015) is deleted and patent is returned to its original state with the assignee name in patent to read --SRI Sports Limited, Kobe (JP)--

Signed and Sealed this
Eighth Day of December, 2015

Michelle K. Lee

Michelle K. Lee
*Director of the United States Patent and Trademark Office*

UNITED STATES PATENT AND TRADEMARK OFFICE

CERTIFICATE OF CORRECTION

PATENT NO. : 8,875,793 B2
APPLICATION NO. : 13/508762
DATED : November 4, 2014
INVENTOR(S) : Øystein Christensen et al.

It is certified that error appears in the above-identified patent and that said Letters Patent is hereby corrected as shown below:

On the Title Page

At item (73), Assignee, change "SRI Sports Limited, Kobe (JP)" to --Future Production, Kristiansand (NO)--.

Signed and Sealed this
Nineteenth Day of September, 2017

Joseph Matal

Joseph Matal
*Performing the Functions and Duties of the*
*Under Secretary of Commerce for Intellectual Property and*
*Director of the United States Patent and Trademark Office*